US008187049B2

(12) United States Patent
Corsiglia et al.

(10) Patent No.: US 8,187,049 B2
(45) Date of Patent: May 29, 2012

(54) TRANSFORMABLE TOY VEHICLE

(75) Inventors: Jeff Corsiglia, Toronto (CA); Charles Sink, Friday Harbor, WA (US); James E Elson, Toronto (CA)

(73) Assignee: Spin Master Ltd., Toronto, Ontario (CA)

( * ) Notice: Subject to any disclaimer, the term of this patent is extended or adjusted under 35 U.S.C. 154(b) by 1149 days.

(21) Appl. No.: 12/012,974

(22) Filed: Feb. 6, 2008

(65) Prior Publication Data

US 2008/0207079 A1 Aug. 28, 2008

Related U.S. Application Data

(60) Provisional application No. 60/899,950, filed on Feb. 7, 2007.

(51) Int. Cl.
*A63H 33/00* (2006.01)

(52) U.S. Cl. ..... 446/37; 446/376; 446/454

(58) Field of Classification Search ..... 446/37
See application file for complete search history.

(56) References Cited

U.S. PATENT DOCUMENTS

| | | | | | |
|---|---|---|---|---|---|
| D287,037 | S | * | 12/1986 | Matsushiro | D21/582 |
| D301,504 | S | * | 6/1989 | Kunihiro | D21/583 |
| 5,474,486 | A | * | 12/1995 | Chilton et al. | 446/456 |
| 8,002,604 | B2 | * | 8/2011 | Van de Rostyne et al. | 446/37 |
| 2006/0231677 | A1 | * | 10/2006 | Zimet et al. | 244/17.23 |
| 2010/0120321 | A1 | * | 5/2010 | Rehkemper et al. | 446/36 |

* cited by examiner

*Primary Examiner* — Melba Bumgarner
*Assistant Examiner* — Tramar Harper
(74) *Attorney, Agent, or Firm* — Cozen O'Connor

(57) ABSTRACT

A remotely controlled transformable toy vehicle that is remotely transformable from a standing position to a flying position, where the toy performs like a helicopter and also to a driving position, where the toy performs like a wheeled vehicle. Transformations are carried out on-the-fly by remote control and the toy vehicle has the ability to maintain proper center of gravity for stable flight, takeoff and landing.

24 Claims, 25 Drawing Sheets

TRANSFORMABLE TOY VEHICLE

RELATED APPLICATIONS

This application claims priority from U.S. Provisional Patent Application Ser. No. 60/899,950 which was filed on Feb. 7, 2007.

BACKGROUND OF THE INVENTION

1. Field of the Invention

The present invention relates to a transformable toy vehicle generally and more specifically to a remotely controlled toy vehicle that is remotely transformable from a standing position, to a flying position where the toy performs like a helicopter, and also to a driving position where the toy performs like a wheeled vehicle.

2. Description of the Related Art

There are various kinds of transformable toy vehicles known in the art. Most such toy vehicles feature a conversion of form that is mainly restricted only to the change of the outer appearance. The conversion is carried out by adding or deleting one or more of the constituting elements of the toy vehicle.

There are also transformable toy vehicles that can be transformed without adding or deleting constituent elements. These transformable toy vehicles are mostly of the type in which the form of a car is converted into other forms. For example, the form of a sports car is converted into a robot form.

The form of conversion where the toy vehicle converts from a robot or other object that can stand erect to a toy vehicle that can fly like a helicopter, and then to one that can drive on the ground like a wheeled vehicle, and back again, is not found in the prior art.

There is, therefore, a need for an innovative transformable toy vehicle that is transformable from a standing position to a flying position, where the toy performs like a helicopter and also to a driving position, where the toy performs like a wheeled vehicle.

There is a further need for a transformable toy vehicle that can make the above-noted transformations by dynamically transforming from one position to the next all while balancing all in-flight forces and maintaining the correct center of gravity for stable flight, takeoff and landing.

There is also a need for a transformable toy vehicle where the above-noted transformations are accomplished automatically by remote control signals and can be done while the transformable toy vehicle is in flight.

There is a further need for a transformable toy vehicle that can land in any one of at least two different positions.

There is another need for a transformable toy vehicle that can be steered, both in the air and on the ground, by differentially driving at least two separate counter-rotating rotor blades at different relative speeds.

SUMMARY OF THE INVENTION

In one aspect of the present invention, there is provided a transformable toy vehicle comprising: a main upper body portion; a lower body portion rotatably connected to said upper body portion, said lower body portion being selectively retainable at various angles relative to an upper body central axis between a first body position where said upper body central axis is generally parallel with a lower body central axis and a second body position where said upper body central axis is at approximately a 90 degree angle relative to said lower body central axis; a rotating blade system including a main drive shaft and at least two lifting blades connected to said drive shaft, said rotating blade system mounted to a back portion of said upper body portion such that said main drive shaft is generally perpendicular to said upper body central axis, and said lifting blades are generally parallel to said upper body central axis; a main drive means connected to said main drive shaft for driving the at least two lifting blades; and a vehicle control unit for controlling said main drive means in response to remote control signals, said vehicle control unit comprising: a micro-processor with memory; and a receiver for receiving said remote control signals.

In another aspect, there is provided a transformable toy vehicle comprising: a main upper body portion; a lower body portion rotatably connected to said upper body portion, said lower body portion being selectively retainable at various angles relative to an upper body central axis between a first body position where said upper body central axis is generally parallel with a lower body central axis and a second body position where said upper body central axis is at approximately a 90 degree angle relative to said lower body central axis; a rotating blade system including a main drive shaft and at least two lifting blades connected to said drive shaft, said rotating blade system mounted to a back portion of said upper body portion such that said main drive shaft is generally perpendicular to said upper body central axis, and said lifting blades are generally parallel to said upper body central axis; at least two arms rotatably affixed to said main upper body portion, said arms being rotatable between a first backward-facing flying position and a second forward-facing driving position; at least two legs rotatably affixed to said lower body portion, said legs rotatable on a common plain between a first position parallel to said lower body central axis and a second position wherein said legs are spread-apart forming an acute angle with said lower body central axis; a main drive means connected to said main drive shaft for driving the at least two lifting blades; an auxiliary body drive means for selectively rotating said upper body portion with respect to said lower body portion between said first body position and said second body position; an auxiliary arm drive means for driving said rotation of said arms between said first flying position and said second driving position; an auxiliary leg drive means for driving said rotation of said legs between said first parallel position and said second spread-apart position; an auxiliary rotating blade system drive means for moving said rotating blade system forward and backward on said upper body portion parallel with said upper body central axis; and a vehicle control unit for controlling said main drive means, said auxiliary drive means, said auxiliary arm drive means, said auxiliary leg drive means and said auxiliary blade system drive means in response to remote control signals, said vehicle control unit comprising: a micro-processor with memory; and a receiver for receiving said remote control signals.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
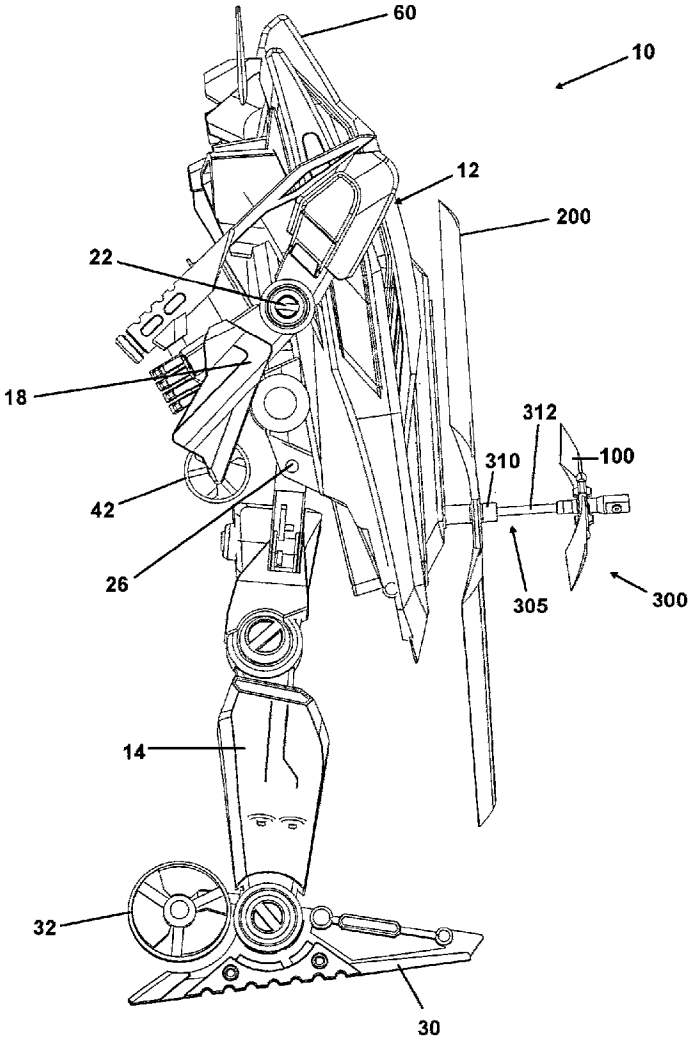
FIG. 1 is a left side view of the transformable toy vehicle in a standing position.

Reference is now made to FIGS. 1 to 5, which show a transformable toy vehicle 10 in a vertical standing position, having a main upper body portion or torso 12, a lower body portion or legs 14 and 16, and arms 18 and 20. In the standing position shown in FIGS. 1 to 5, a main body portion central axis is generally parallel to a lower body portion central axis. Arms 18 and 20 are rotatably affixed to main body 12 on a shaft 22 driven by a servo motor connected to a cam plate 24 and a gear train 25 (see FIGS. 21 and 22). Legs 14 and 16 are rotatably affixed to main body 12 on a shaft 26, permitting main body 12 to rotate forward relative to the legs 14, 16. Main body 12 is selectively retainable at various angles relative to the legs 14,16 between a first position shown in FIGS. 1 to 5 were the main body central axis is generally parallel to the lower body central axis and a second takeoff/landing position shown in FIGS. 6 to 10 where the main body central axis is at approximately a 90 degree angle relative to the lower body central axis. For example, main body 12 may also be retained in a driving position, as shown in FIGS. 16 to 20. Shaft 26 is also driven by a servo-motor, cam plate and gear train system. To provide stability when in the standing and diving positions, legs 14 and 16 can be spread apart from each other on pivot points 28, driven by a gear system 29 connected to a servo motor.

Legs 14, 16 are each provided with skids or feet 30. Feet 30 are positioned to be engageable with the ground to provide stability for the transformable toy vehicle 10 when in the standing and takeoff/landing modes. In the driving position, as shown in FIGS. 16 to 20, feet 30 are positioned up off the ground so as not to make contact with the surface.

Legs 14, 16 are each provided with freely rotatable wheels 32 and arms 18 and 20 are each provided with freely rotatable wheels 42. As shown in FIGS. 16 to 20, wheels 32 and 42 are positioned to be engaged with the ground when the transformable toy vehicle 10 is in the driving position, permitting the transformable toy vehicle 10 to be driven over the surface like a wheeled vehicle.

A rotating blade system 300 is affixed to the back portion of main body 12. Rotating blade system 300 includes two counter-rotating blades, a lower rotor blade 200 and an upper rotor blade 100. A main coaxial drive shaft 305 provides rotating power to the two counter-rotating blades 100, 200. The main coaxial drive shaft 305 consists of two parts: an outer main drive shaft 310 and an inner main drive shaft 312. Outer main drive shaft 310 is driven by an outer drive shaft motor and gear system to provide rotating power to the lower blade 200. Inner main drive shaft 312 is driven by a separate inner drive shaft motor and gear systems to provide rotating power to the upper blade 100. The two parts of main coaxial drive shaft 305 rotate in opposite directions and can be driven at different speeds, if required, for steering the transformable toy vehicle 10 in the air and on the ground. The counter-rotating movement of the two blades 100, 200, cancel each other's angular torque and provide stability.

The two counter-rotating blades 100 and 200 provide lifting force for the transformable toy vehicle 10 when in the takeoff mode shown in FIGS. 6 to 10 and in the flying mode shown in FIGS. 11 to 15, and forward driving force when in the driving mode shown in FIGS. 16 to 20.

The blades 100 and 200 each have a slight forward bias and can be driven at different relative speeds by the separate inner and outer drive shaft motors, respectively. When blades 100 and 200 are driven at different relative speeds, side forces are developed, which when combined with the slight forward bias of the blades can be used to steer the transformable toy vehicle 10 while in both the flying and the driving modes.

Rotating blade system 300 may include bell stabilizers 106 (see FIGS. 22 and 23) connected to the coaxial drive shaft 305 adjacent the upper 100 and/or lower 200 blades.

Figure 22:
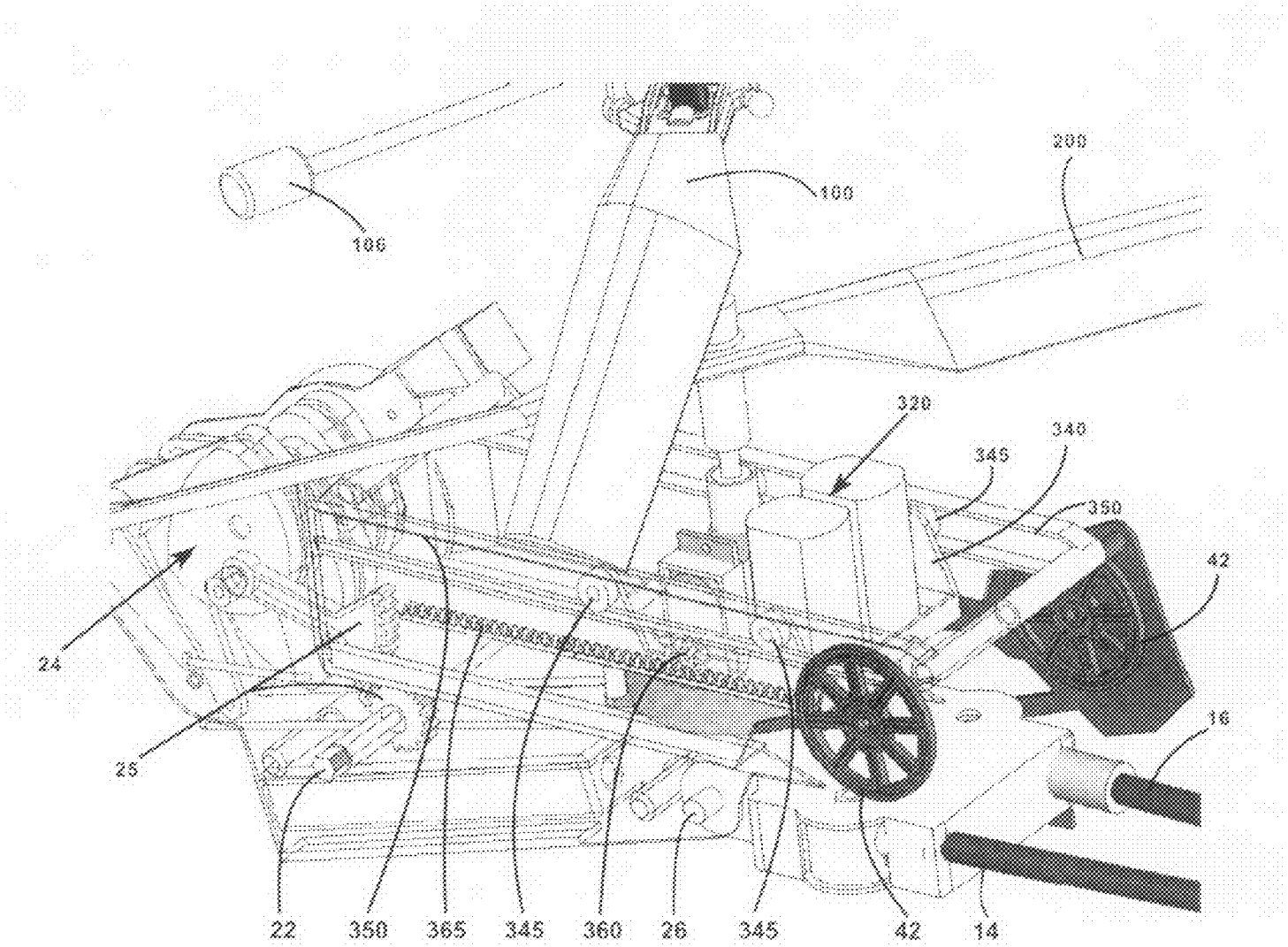
FIG. 22 is a left side perspective, cut-away, partial interior view of the transformable toy vehicle with the shell coverings removed.
Figure 23:
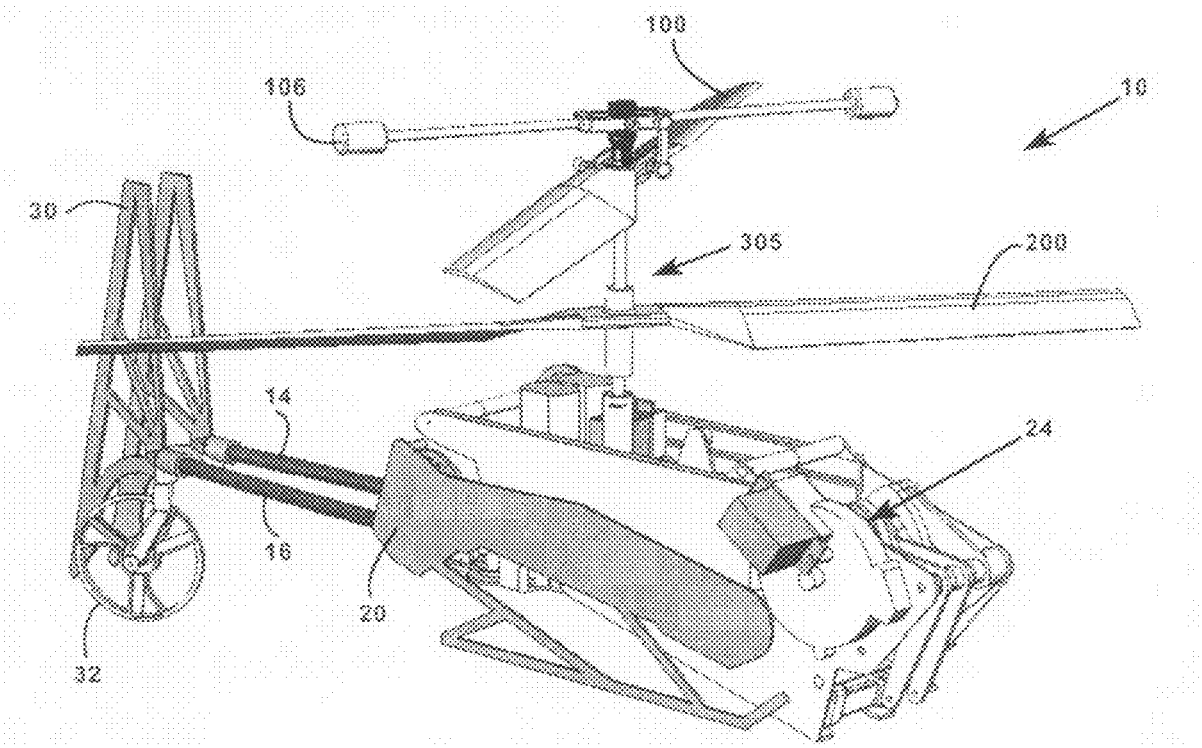
FIG. 23 is a right side perspective, view of the transformable toy vehicle in the flying position with the shell coverings removed.

Rotating blade system 300 includes a main drive power assembly 320 as shown in FIG. 22 to provide power to the inner and outer drive shaft motors, respectively. Power assembly 320 may be a rechargeable battery, simple battery, capacitance device, super capacitor, micro power capsule, fuel cells, fuel or other micro power sources.

Rotating blade system 300, is mounted to a carrier frame 340, including a set of rollers 345 engaged with rails 350 aligned parallel and connected to the main body 12. A drive gear 360 engaged with a toothed rack 365 affixed to main body 12 is driven by a servo motor and moves the entire rotating blade system 300 forward and backward on main body 12, along rails 350, to ensure that the proper center of gravity is at all times maintained for stable flight as the main body 12, the legs 14, 16 and the arms 18, 20 rotate relative to each other to transform the toy vehicle 10 into the different configurations shown herein.

The transformable toy vehicle 10 includes a vehicle control unit (not shown) comprising a circuit board including a radio receiver and a micro-processor with memory for controlling the entire operation of the transformable flying toy vehicle 10. The vehicle control unit includes a digital radio frequency (RF) decoder chip that receives control signals from a remote transmitter. The micro-processor keeps track of the positions of all components of the transformable toy vehicle 10, namely main body 12, the legs 14, 16 and the arms 18, 20, and coordinates the transforming motions based on the control signals received from the remote transmitter.

Preferably, the control signals from the remote transmitter are transmitted by electromagnetic frequencies, such as radio frequency (RF), or infrared (IR), but one will appreciate that sound frequencies such as ultra sound, or voice commands could be used, or any other suitable method for transmitting remote control signals. The vehicle control unit may also consist of a pre programmed flying control, or programmable flying control to be programmed by the user.

A remote control unit (not shown) including the remote transmitter, may preferably be used by an operator to control the transformable toy vehicle 10. The remote control unit will have throttle controls for controlling the power to both inner and outer drive shaft motors, and left/right and forward/backwards controls for steering while in the flying and driving modes. The remote control unit will have controls for rotating the arms 14, 16 from a standing position (FIGS. 1 to 5) to a landing/takeoff and flying position (FIGS. 6 to 15) and then to a driving position (FIGS. 16 to 20). The remote control unit will have controls for rotating main body 12 forward into a takeoff/landing position and then back into a standing position and for rotating legs 14, 16 to a flying position and to a driving position. The remote control unit will also have controls for spreading legs 14, 16 apart when in standing mode, landing/takeoff mode and driving mode, and for moving legs 14, 16 together when in flying mode.

Figure 2:
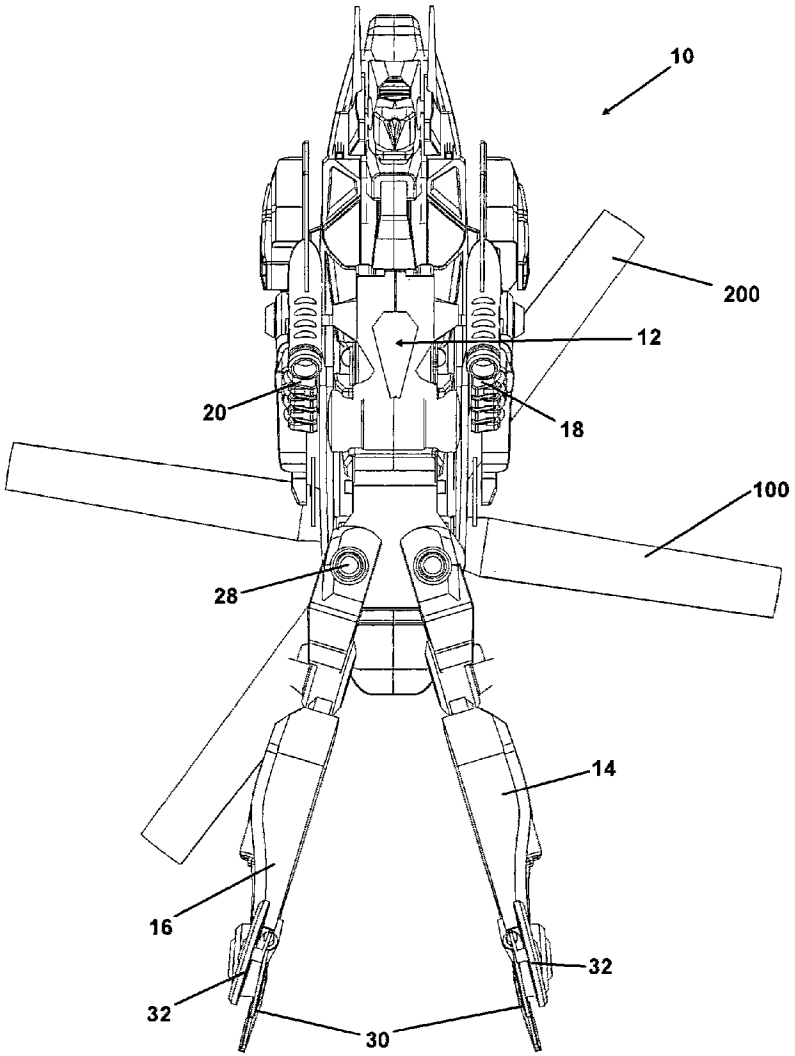
FIG. 2 is a front view of the transformable toy vehicle in a standing position.
Figure 3:
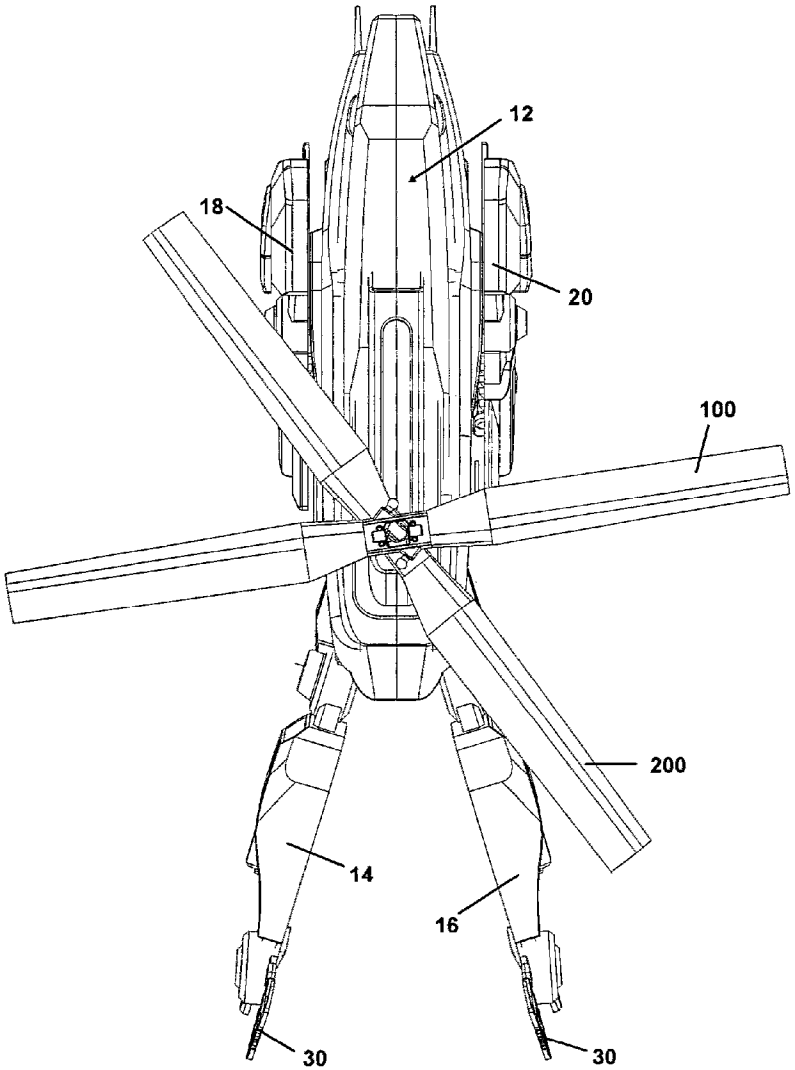
FIG. 3 is a rear view of the transformable toy vehicle in a standing position.
Figure 4:
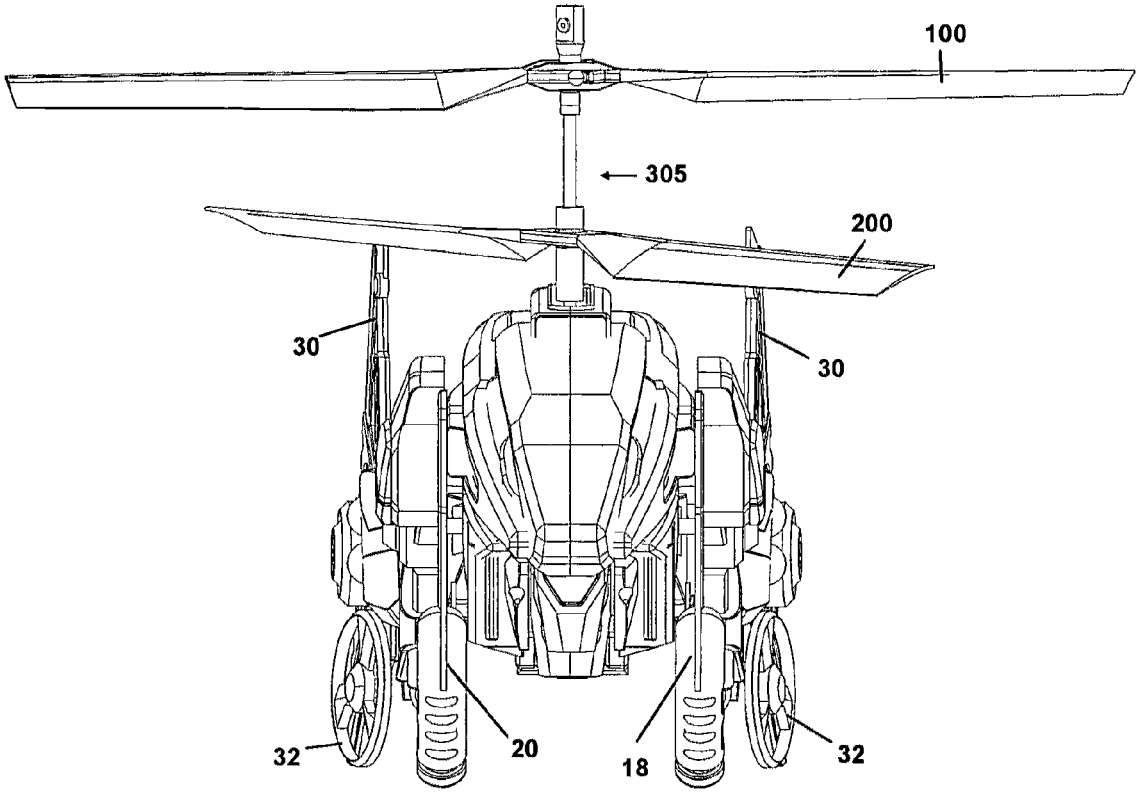
FIG. 4 is a top-down view of the transformable toy vehicle in a standing position.
Figure 5:
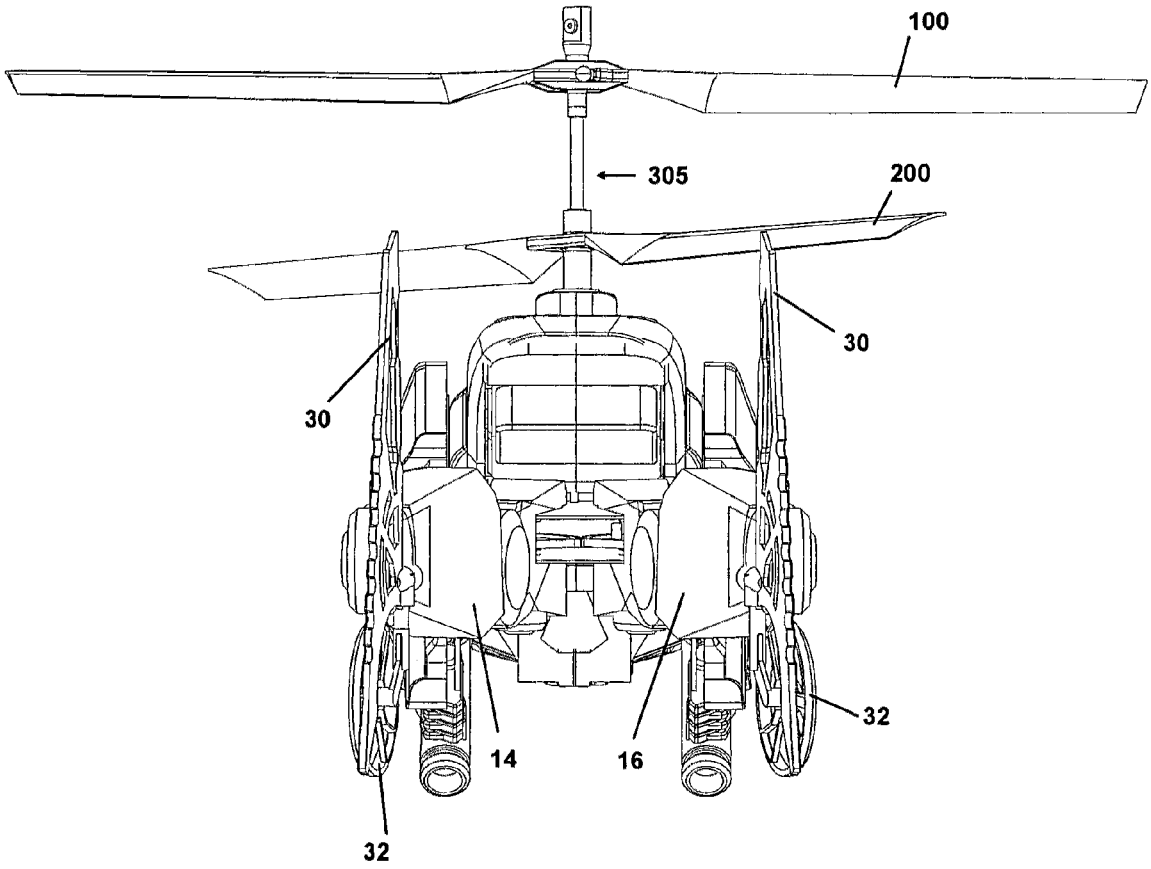
FIG. 5 is a bottom-up view of the transformable toy vehicle in a standing position.

In operation, the transformable toy vehicle 10 is first located in an erect standing position, as shown in FIGS. 1 to 5, with the main coaxial drive shaft 305 positioned generally parallel to the ground surface and the upper and lower rotor blades 100, 200 generally parallel with the main body 12 and legs 14, 16. Legs 14, 16 are spread wide apart, as shown in FIGS. 2 and 3, for stability.

To prepare for takeoff, a signal is sent from the remote transmitter to the receiver in the vehicle control unit to rotate the main body 12 forward 90 degrees with respect to legs 14, 16, as shown in FIGS. 6 to 10, into a takeoff position. This motion moves the upper and lower rotor blades 100, 200 generally horizontal to the ground surface allowing the blades to provide positive vertical lift. At the same time, the entire rotating blade system 300 is moved slightly forward on rails 350 by drive gear 360 (this motion is not illustrated in the attached drawings) and arms 18, 20 are rotated back counterclockwise about 45 degrees into a more aerodynamic position for flying. These movements are precisely calculated and coordinated to provide the transformable toy vehicle 10 with the proper center of gravity for stable flight.

To take off, the throttle control on the remote control unit is advanced forward and the transformable toy vehicle 10 lifts off the ground when the speed of the rotor blades 100, 200 is sufficient to provide the necessary lift. Increasing the throttle will increase the altitude. Steering is accomplished by adjusting the left/right and forward/backwards controls on the remote control unit, which causes the upper and lower counter-rotating blades 100, 200 to be driven at different relative speeds.

Figure 7:
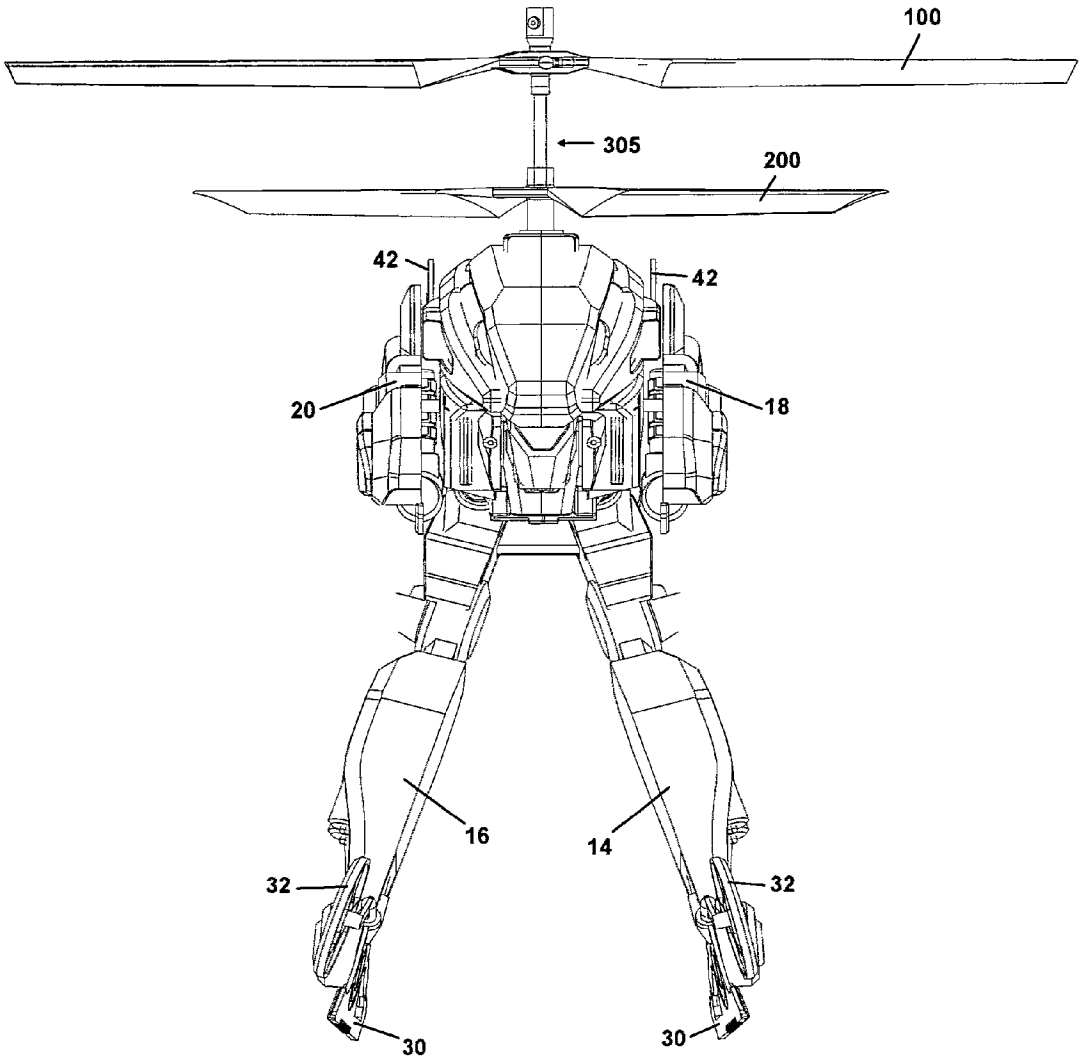
FIG. 7 is a front view of the transformable toy vehicle in a takeoff/landing position.
Figure 8:
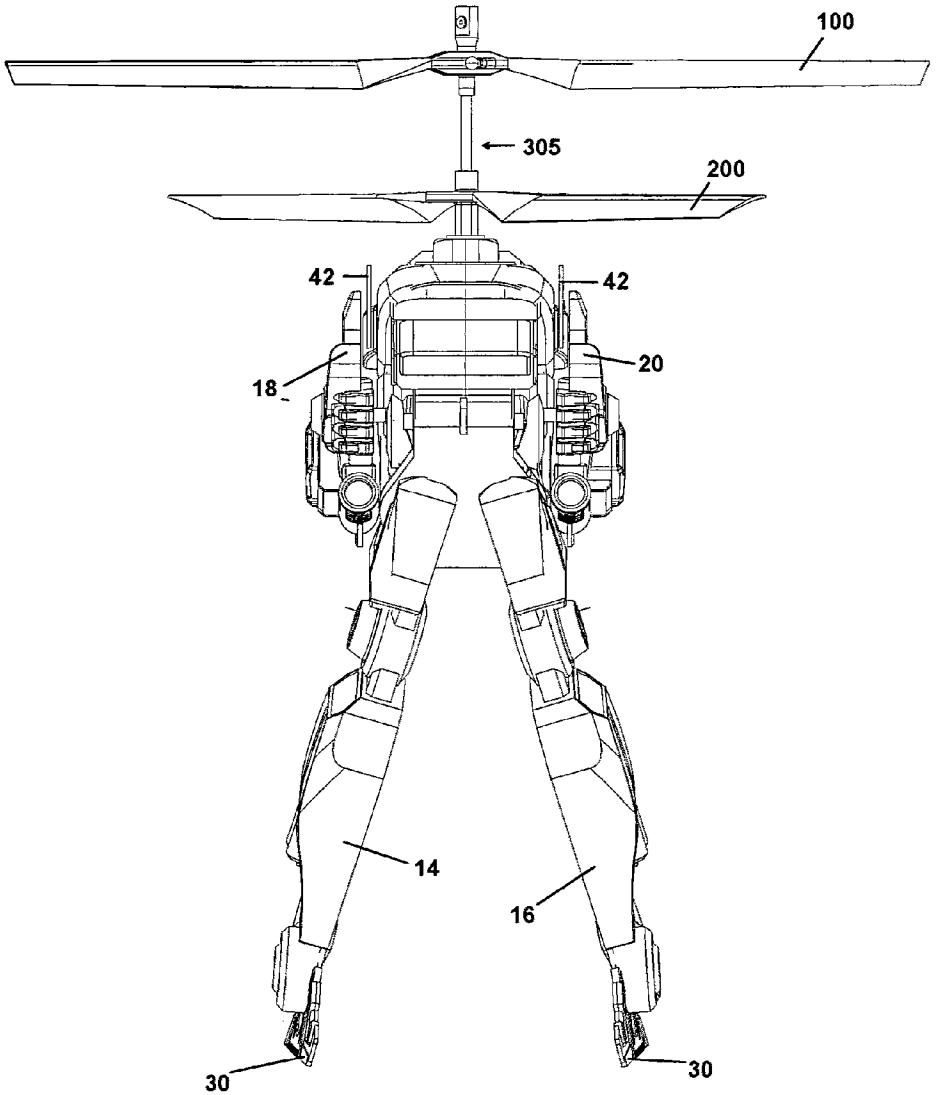
FIG. 8 is a rear view of the transformable toy vehicle in a takeoff/landing position.
Figure 9:
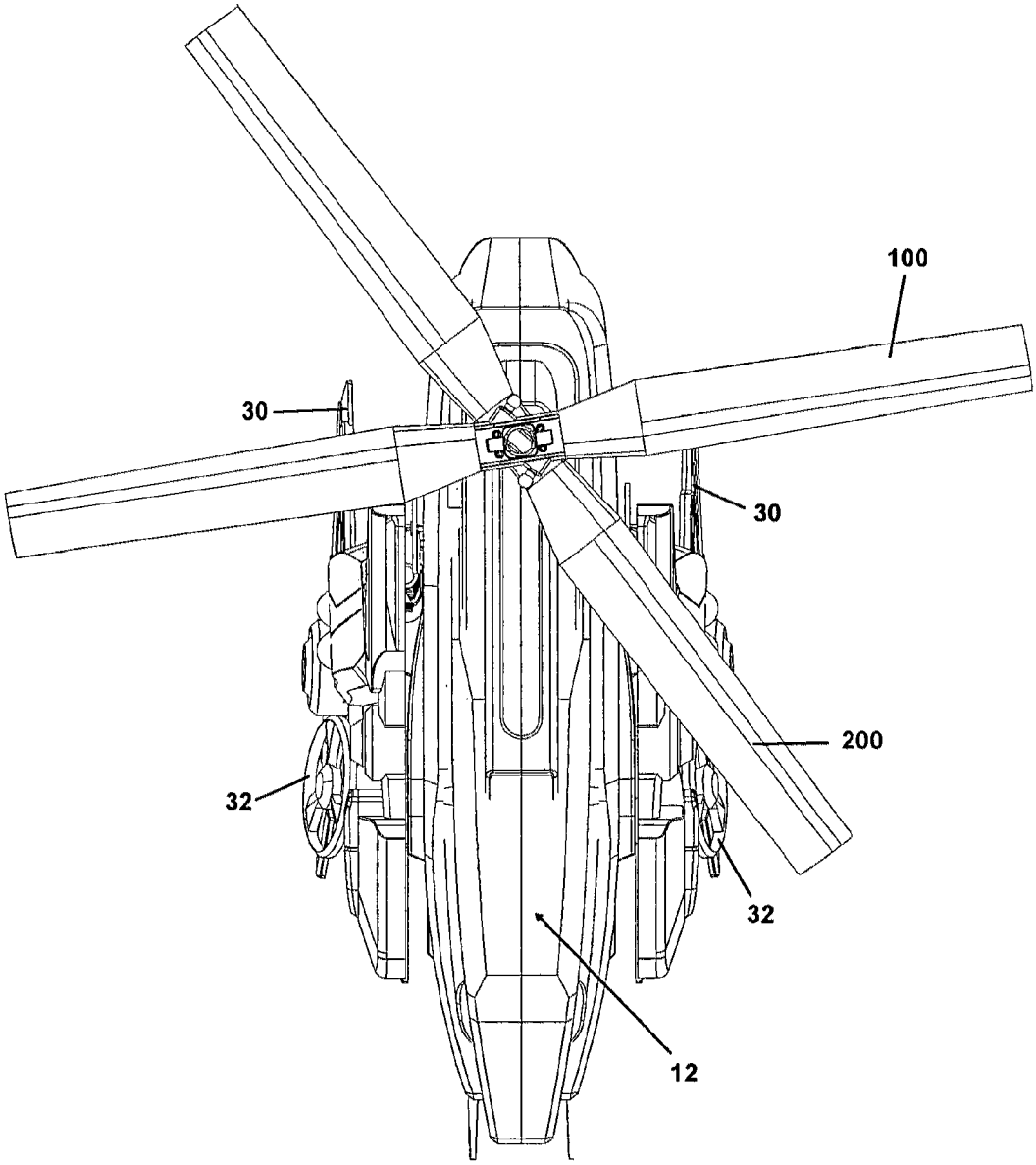
FIG. 9 is a top-down view of the transformable toy vehicle in a takeoff/landing position.
Figure 10:
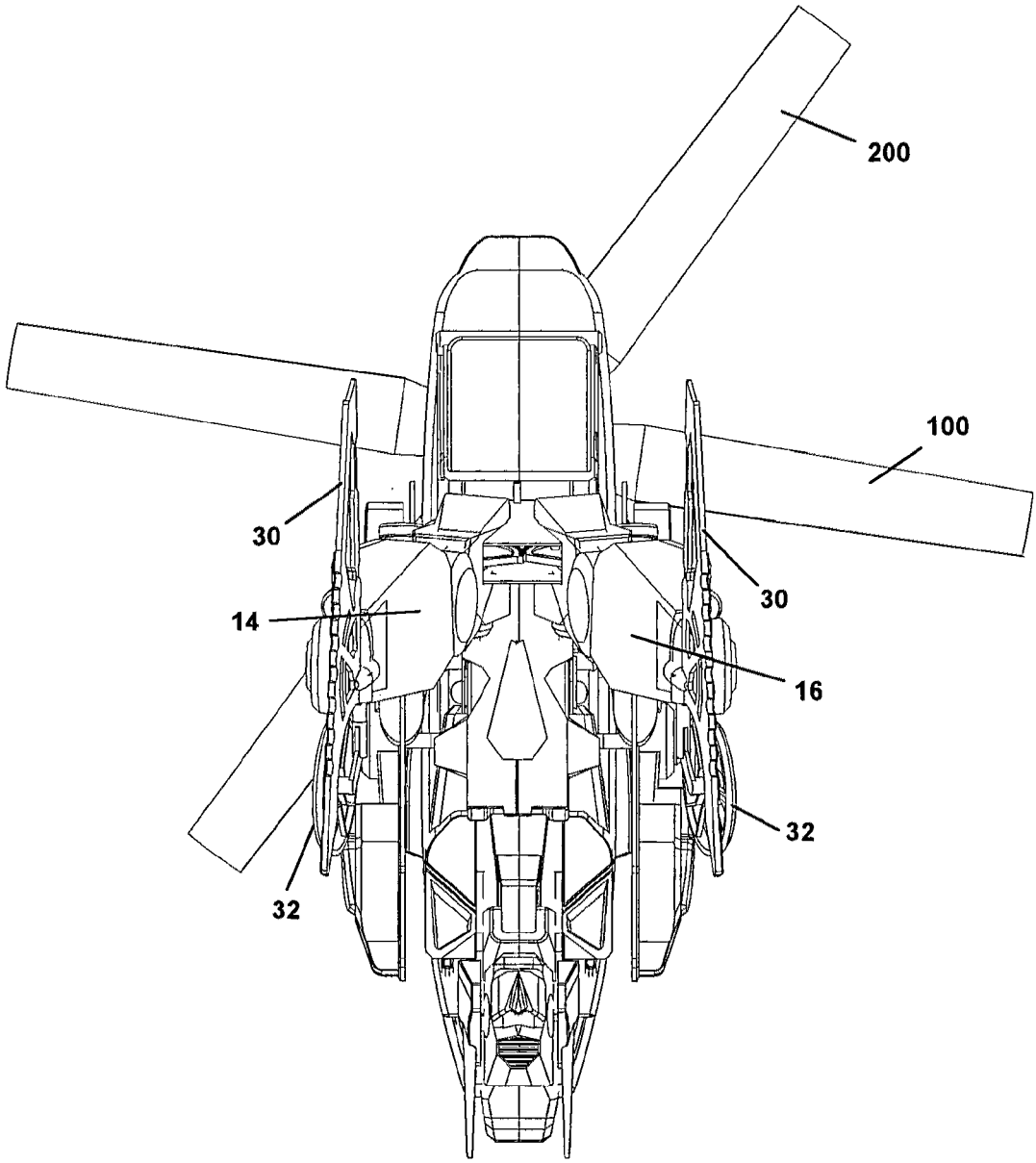
FIG. 10 is a bottom-up view of the transformable toy vehicle in a takeoff/landing position.
Figure 11:
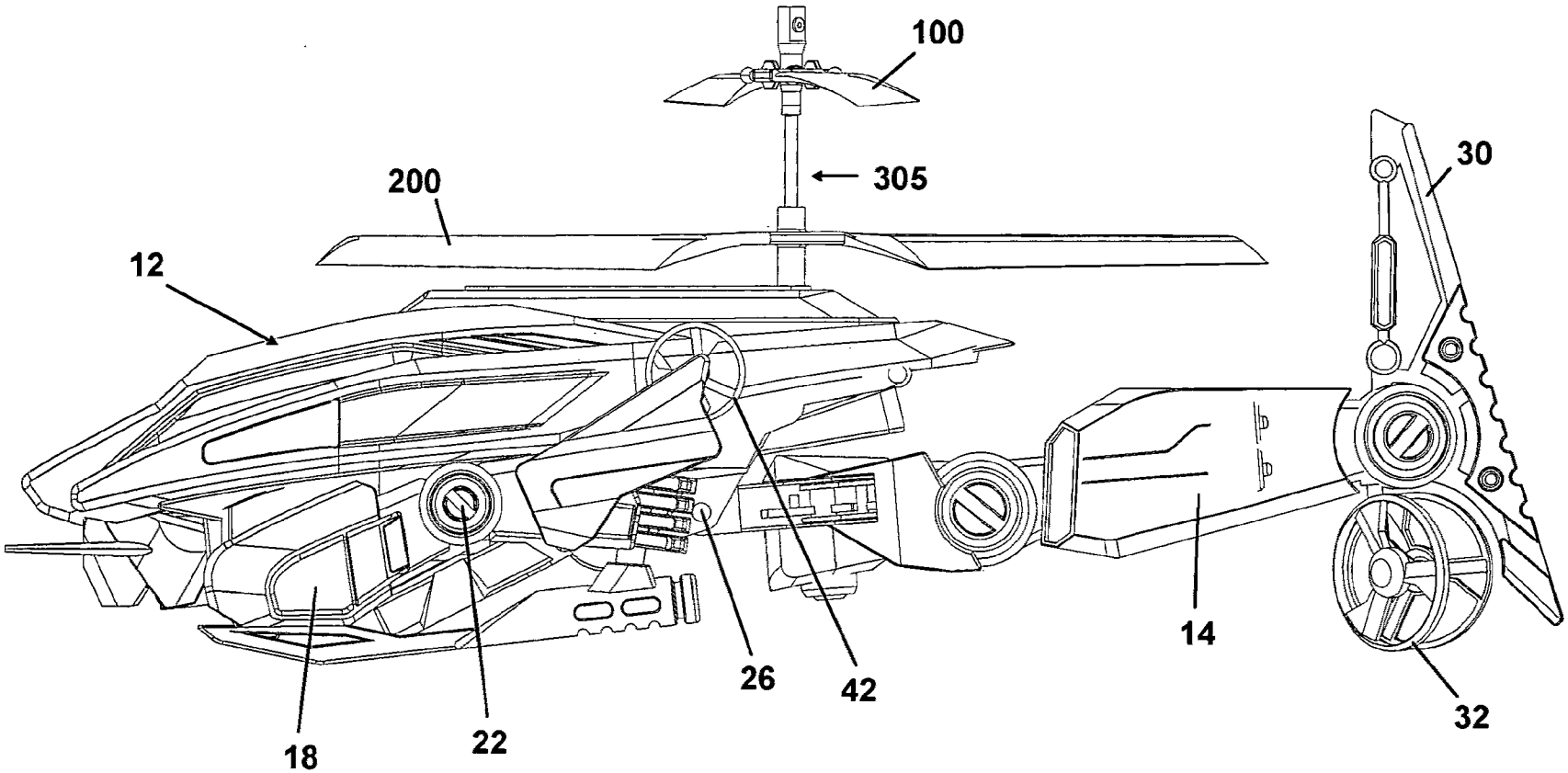
FIG. 11 is a left side view of the transformable toy vehicle in a flying position.
Figure 12:
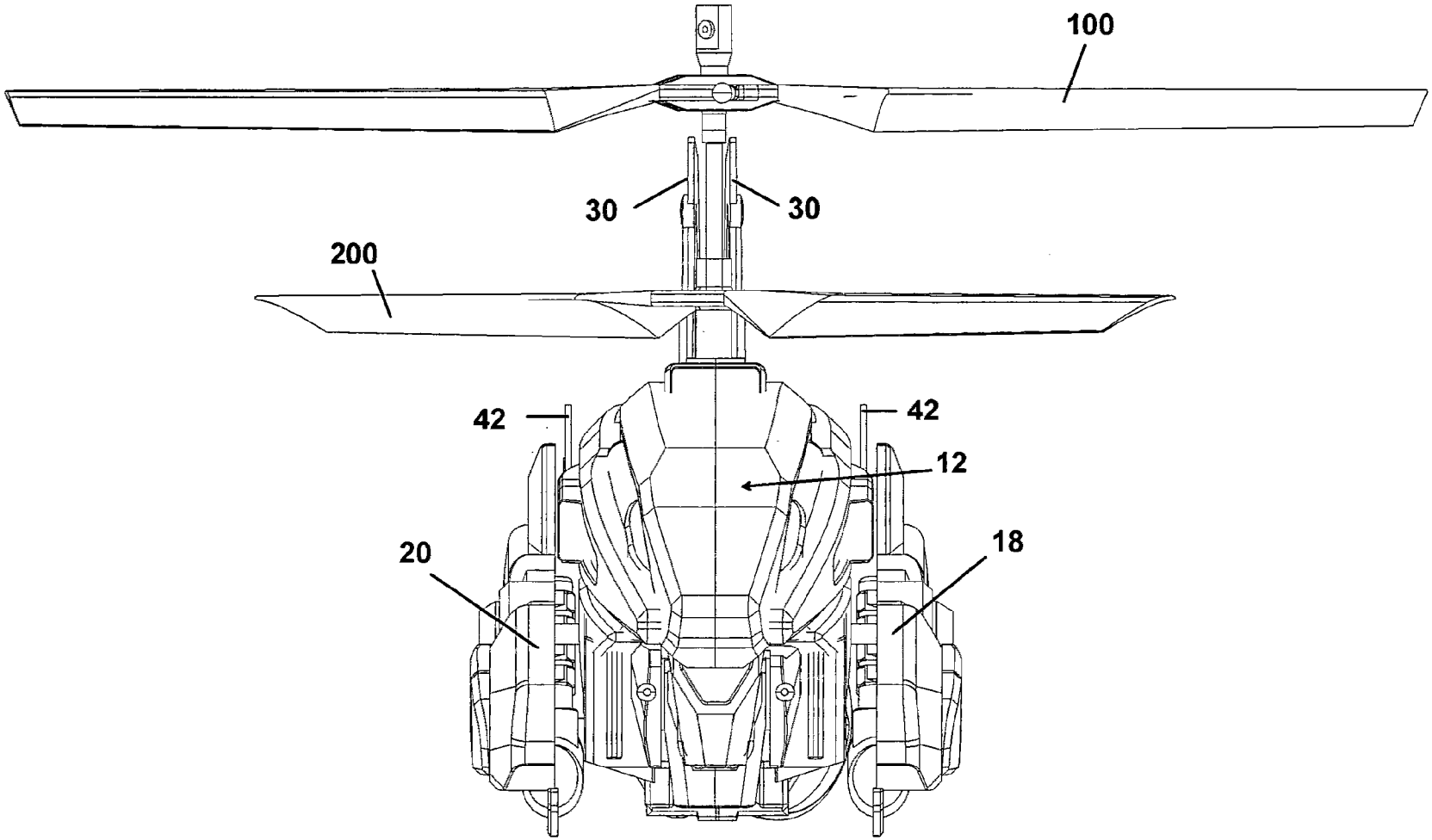
FIG. 12 is a front view of the transformable toy vehicle in a flying position.
Figure 13:
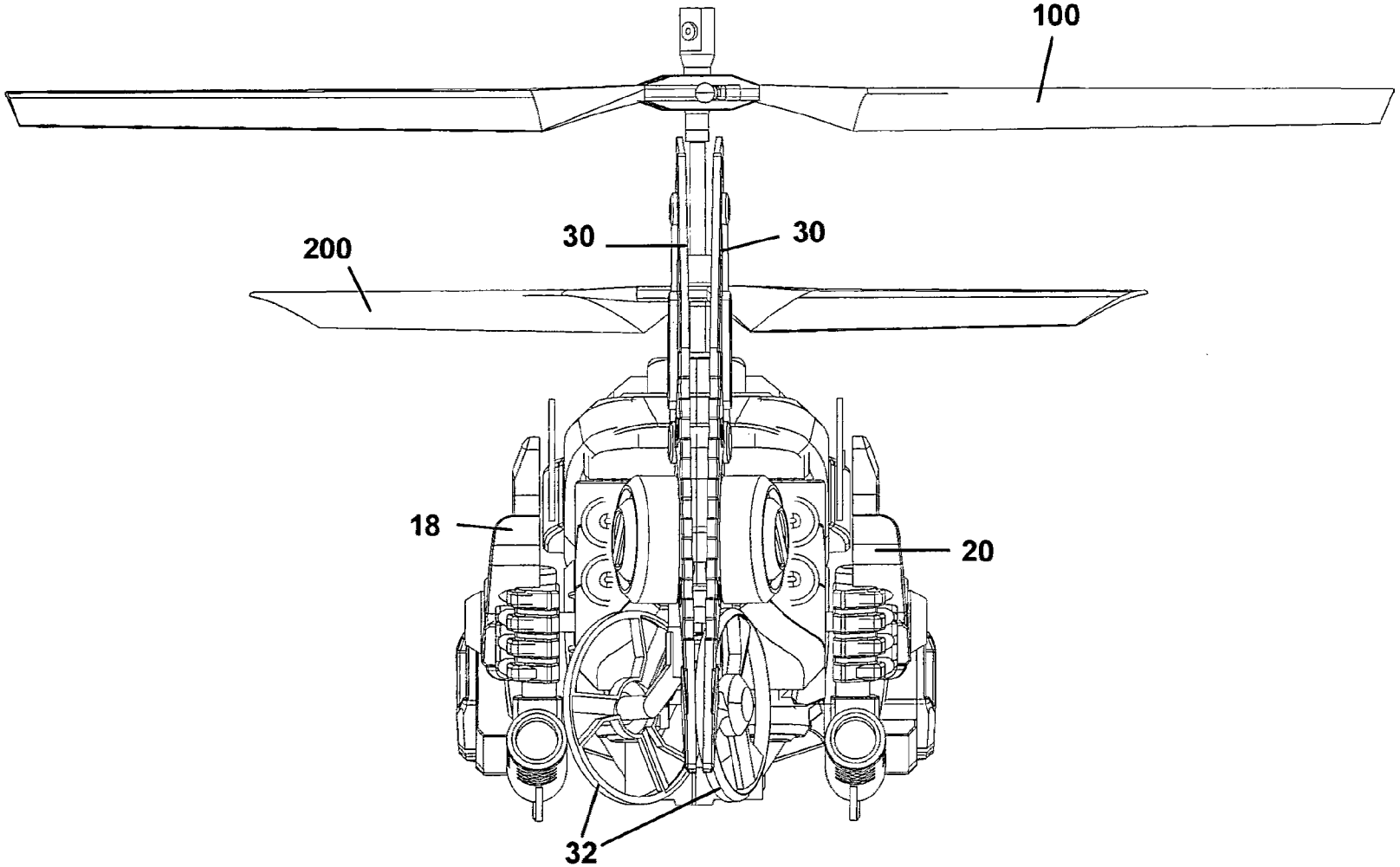
FIG. 13 is a rear view of the transformable toy vehicle in a flying position.
Figure 14:
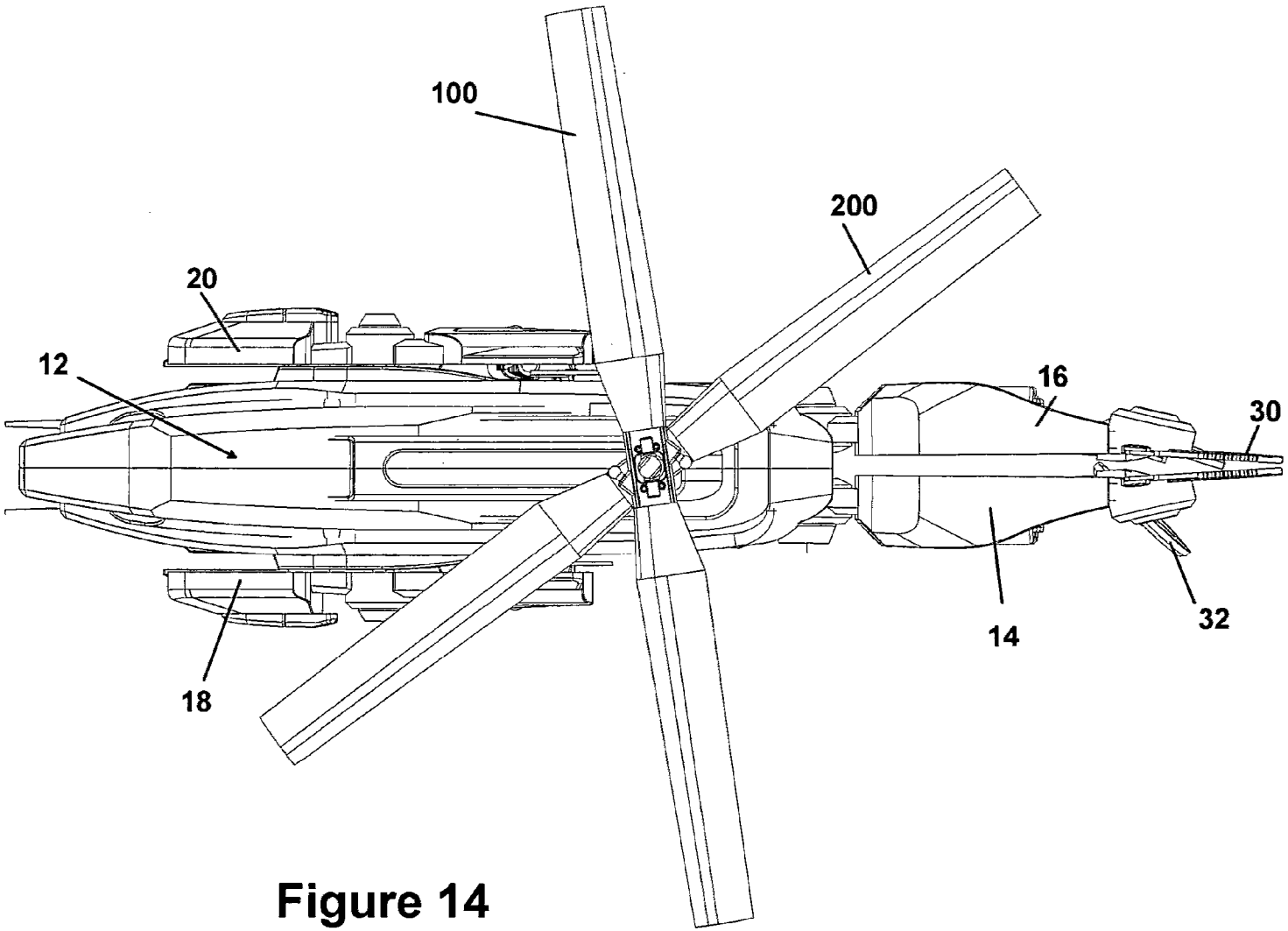
FIG. 14 is a top-down view of the transformable toy vehicle in a flying position.
Figure 15:
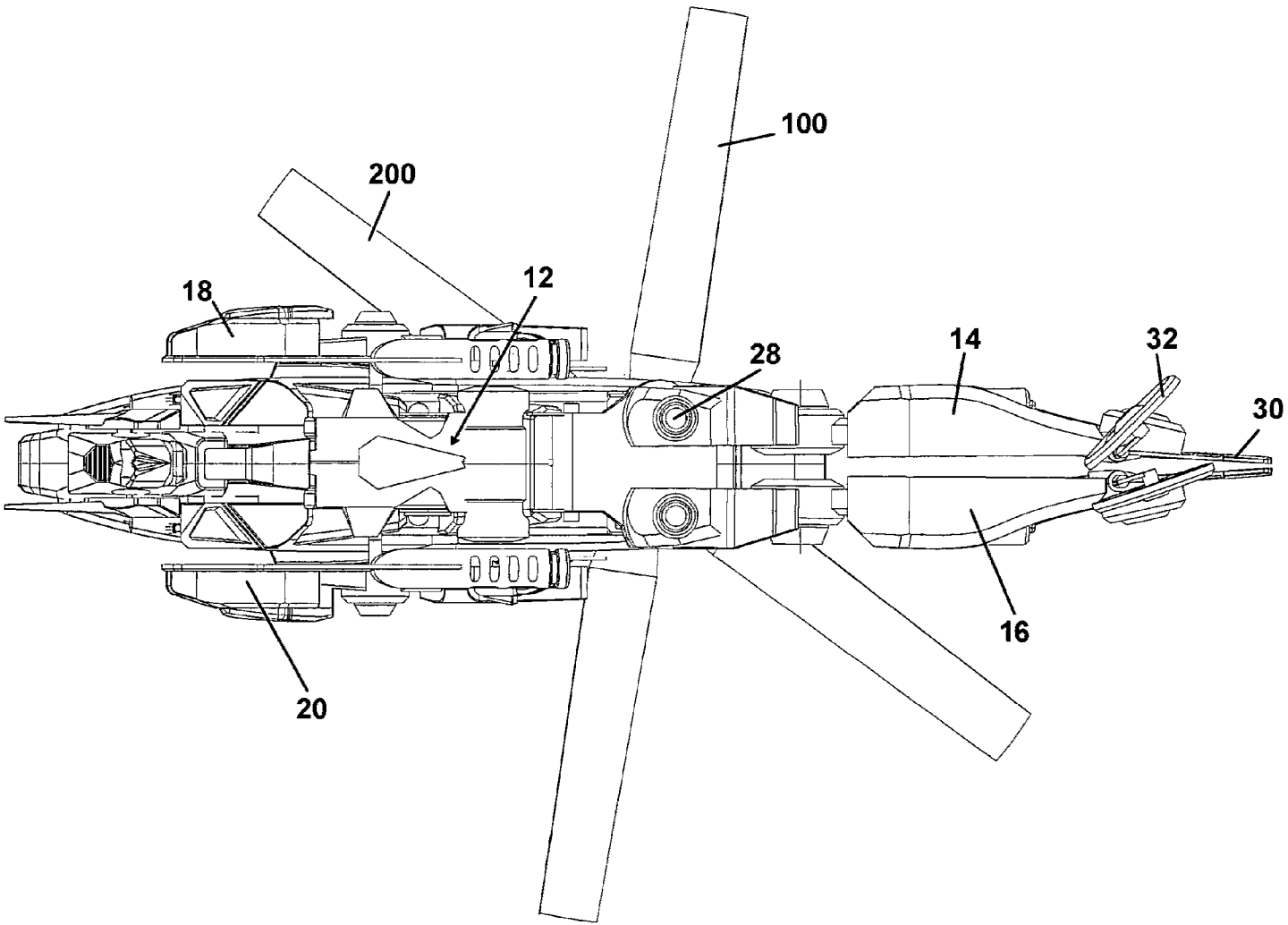
FIG. 15 is a bottom-up view of the transformable toy vehicle in a flying position.

Once air born, a signal may be sent from the remote control unit to cause legs 14, 16 to rotate to a horizontal position as shown in FIGS. 11 to 16, parallel with the main body 12. The legs 14, 16 are also drawn together from a spread-wide position as shown in FIG. 7, to a drawn-together position as shown in FIGS. 14 and 15. To accommodate the shift in center of gravity caused by these movements, the entire rotating blade system 300 is moved forward on main body 12 by drive gear 360 (this motion is not illustrated in the attached drawings). These movements are all driven and timed by a set of grooved cam plates 24, gears, and an indexing wheel, all driven by a servo motor or motors. The micro-processor of the vehicle control unit links and coordinates the movements so that the optimal center of gravity is at all times maintained for proper, stable flight. Alternatively, in place of the indexing wheel, a hexadecimal 16 position switch may be used to perform the same function.

Figure 16:
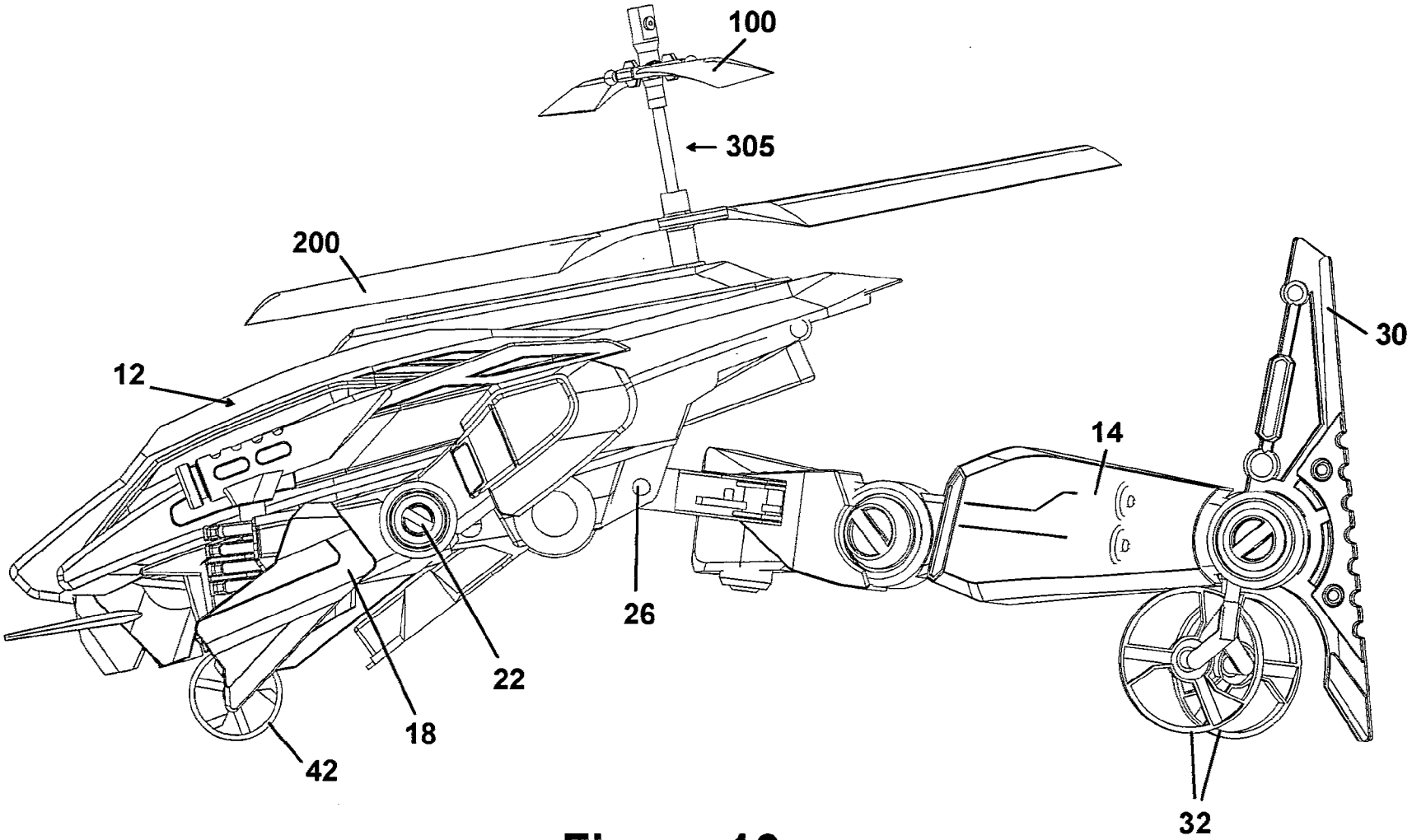
FIG. 16 is a left side view of the transformable toy vehicle in a driving position.
Figure 17:
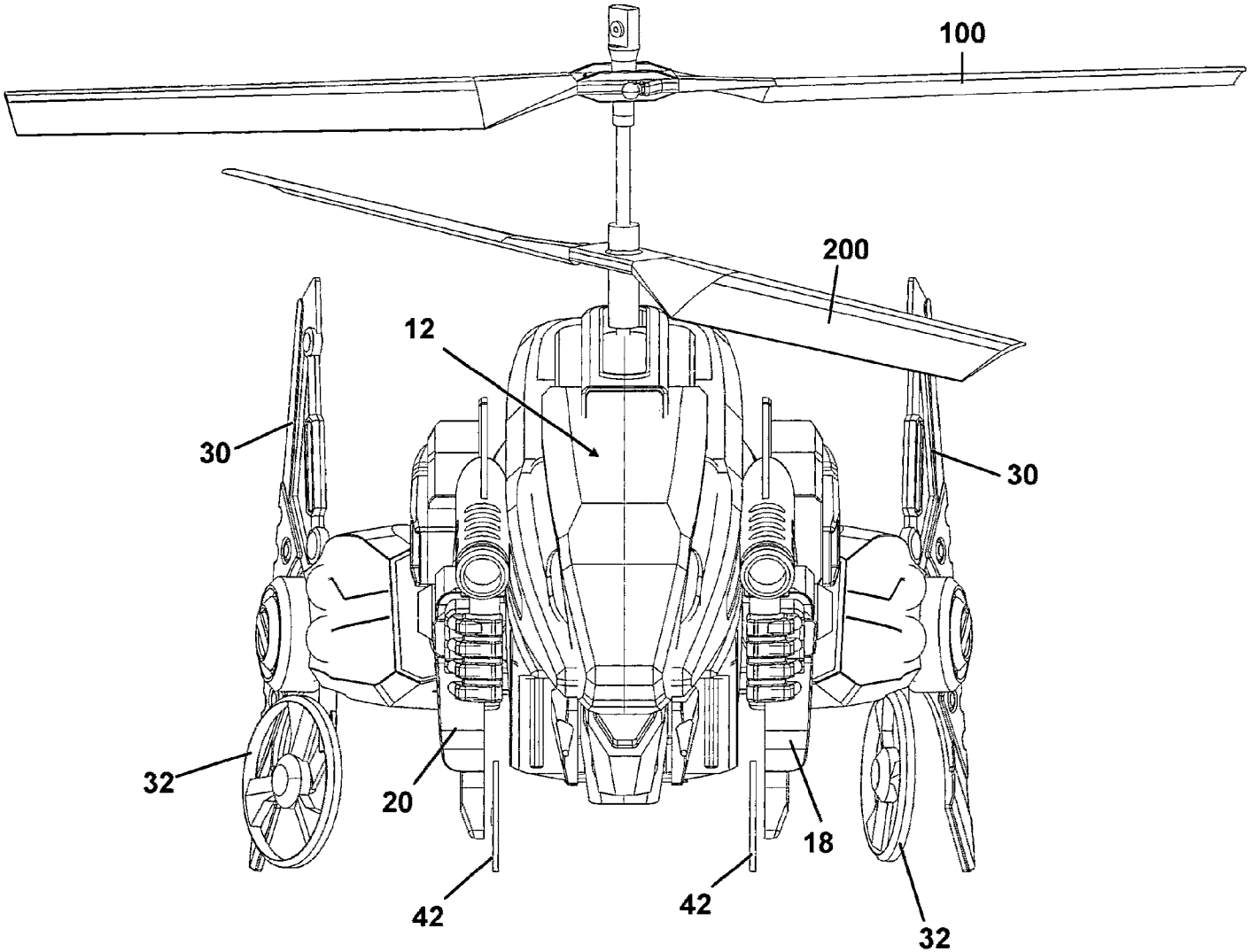
FIG. 17 is a front view of the transformable toy vehicle in a driving position.
Figure 18:
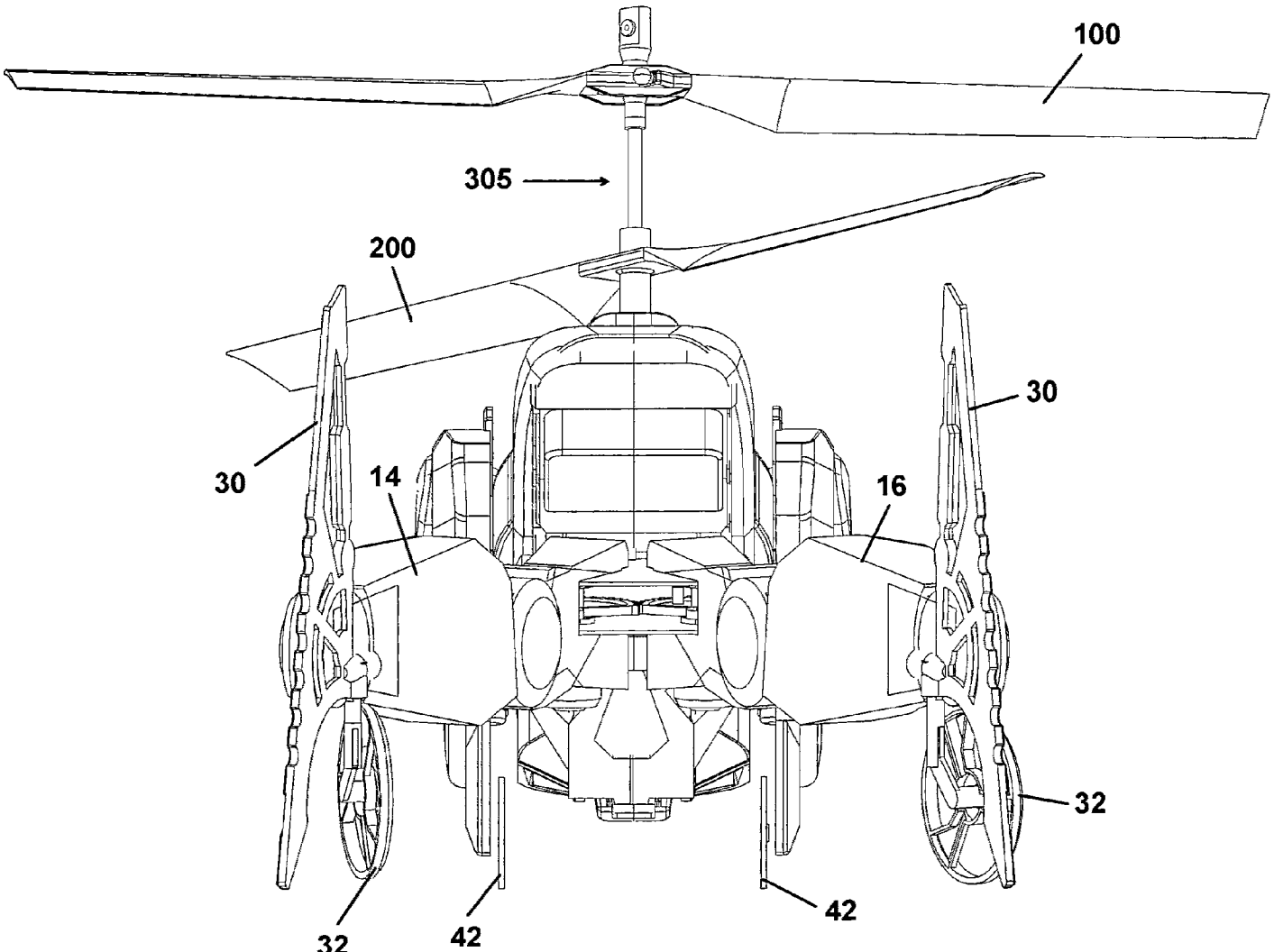
FIG. 18 is a rear view of the transformable toy vehicle in a driving position.
Figure 19:
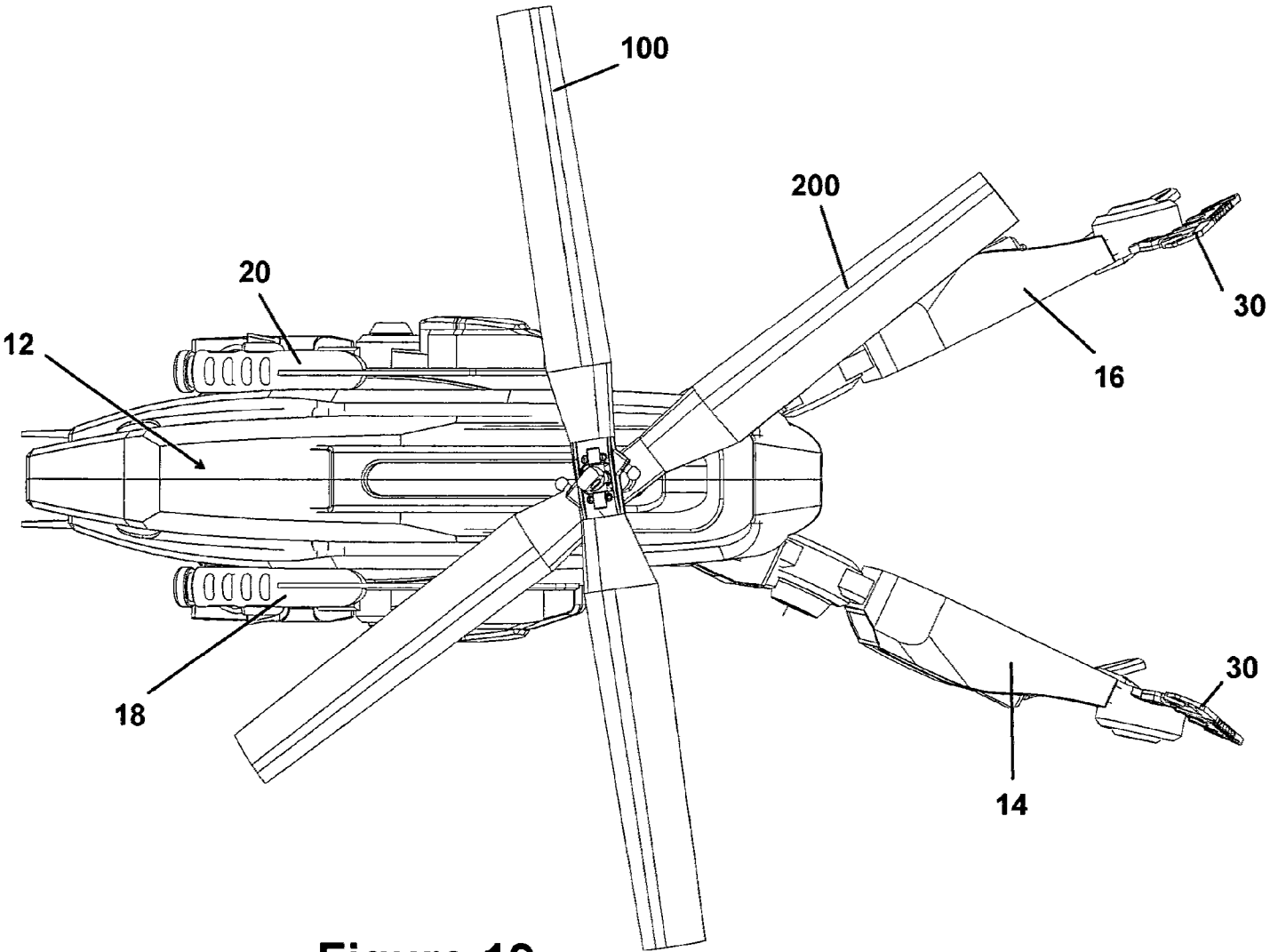
FIG. 19 is a top-down view of the transformable toy vehicle in a driving position.
Figure 20:
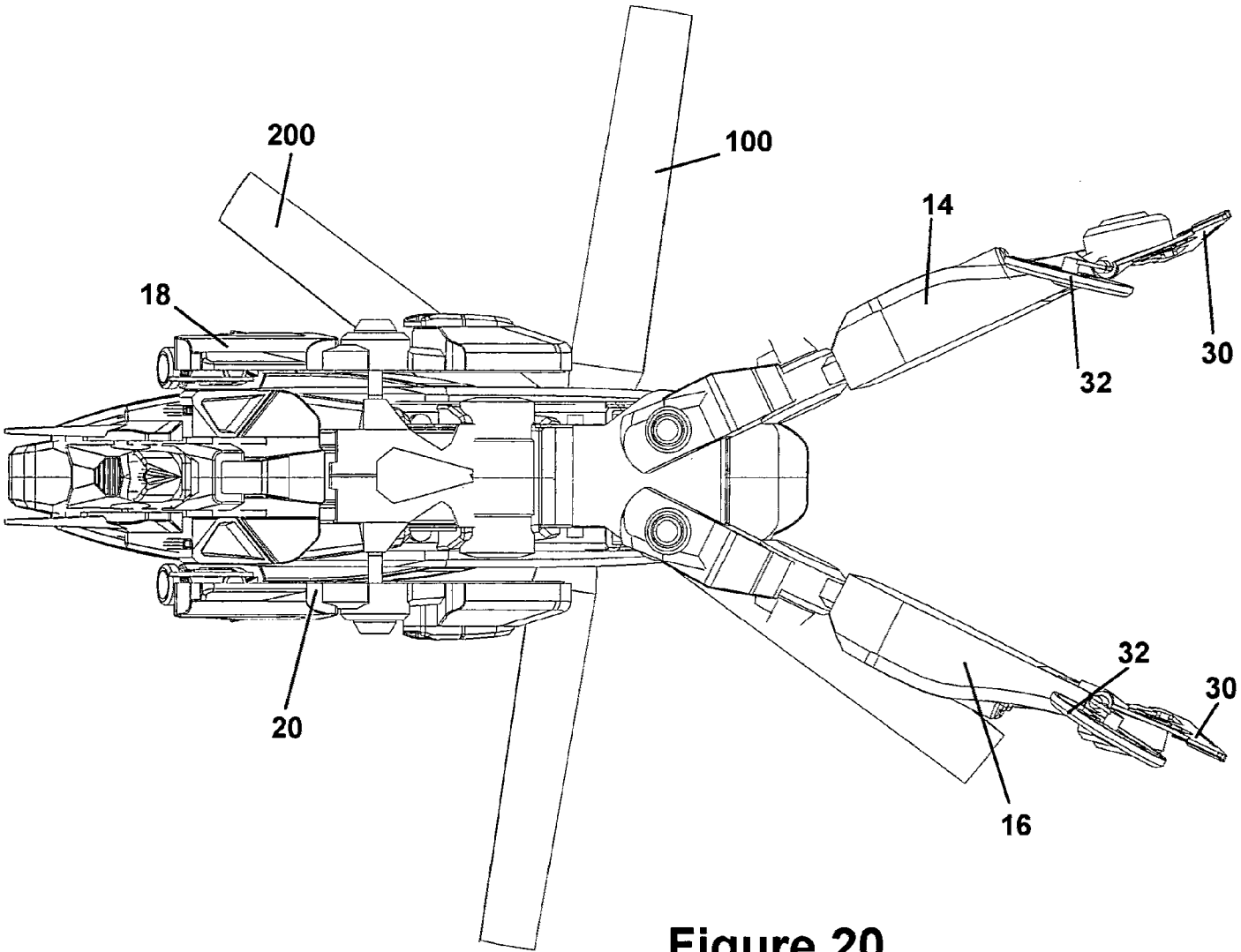
FIG. 20 is a bottom-up view of the transformable toy vehicle in a driving position.
Figure 21:
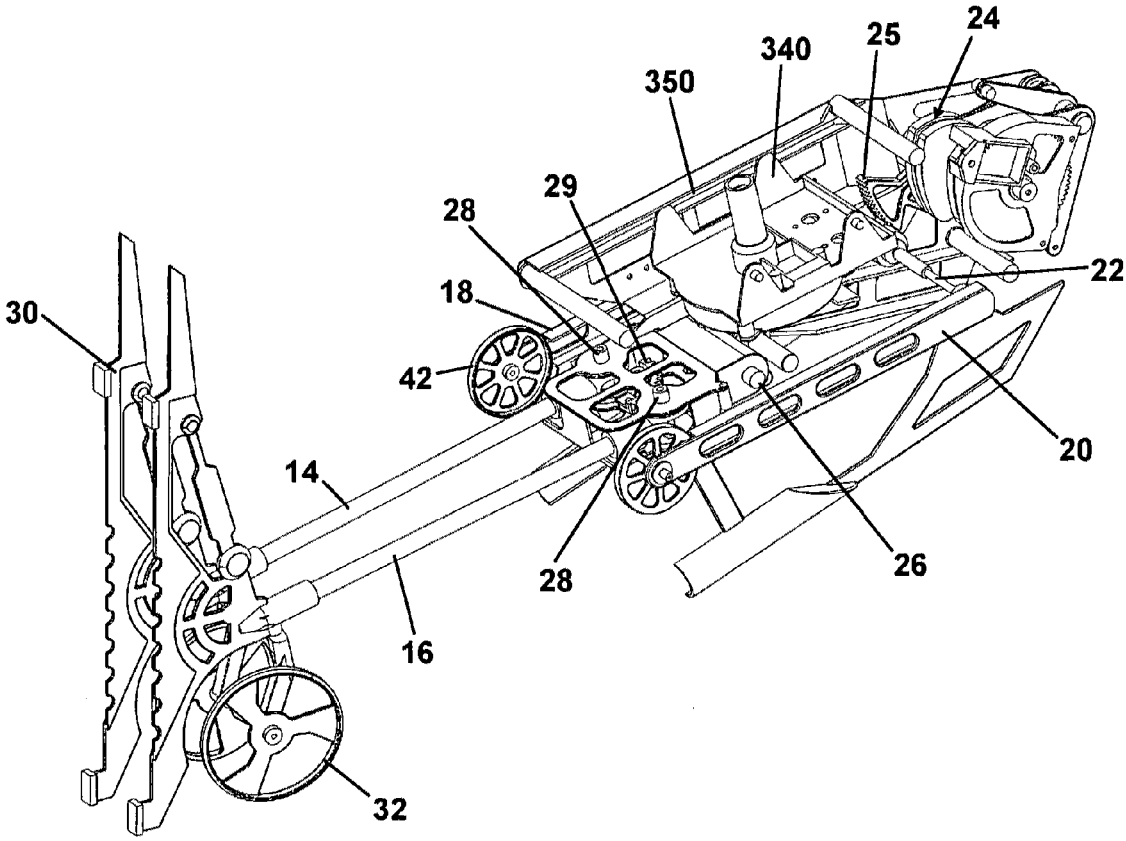
FIG. 21 is a right side perspective, cut-away, partial interior view of the transformable toy vehicle in the flying position with the shell coverings removed.

During flight, and in preparation for landing, a command may be sent from the remote control unit to the vehicle control unit to rotate arms 18 and 20 in a clockwise direction to a position as shown in FIG. 16, in which wheels 42 are positioned downward for engagement with the surface. At the same time, main body 12 is rotated slight forward with respect to legs 14, 16, and legs 14, 16 are spread apart as shown in FIGS. 19 and 20. The position of the rotating blade system 300 is adjusted as necessary to maintain the proper center of gravity for stable flight (this motion is not illustrated in the attached drawings). When power to the throttle is reduced, the altitude of the transformable toy vehicle 10 drops sufficiently so that wheels 32 and 42 engage gently with the ground surface and the transformable toy vehicle 10 can be driven over the surface like a wheeled vehicle. While in the driving position, as shown in FIGS. 16 to 20, the transformable toy vehicle 10 can be steered by differentially controlling the relative speeds of the two counter-rotating coaxial drive shafts 310 and 312, controlled by signals from the remote control unit using left/right steering controls. A forward bias of the blades 100, 200 provides the forward thrust.

Figure 6:
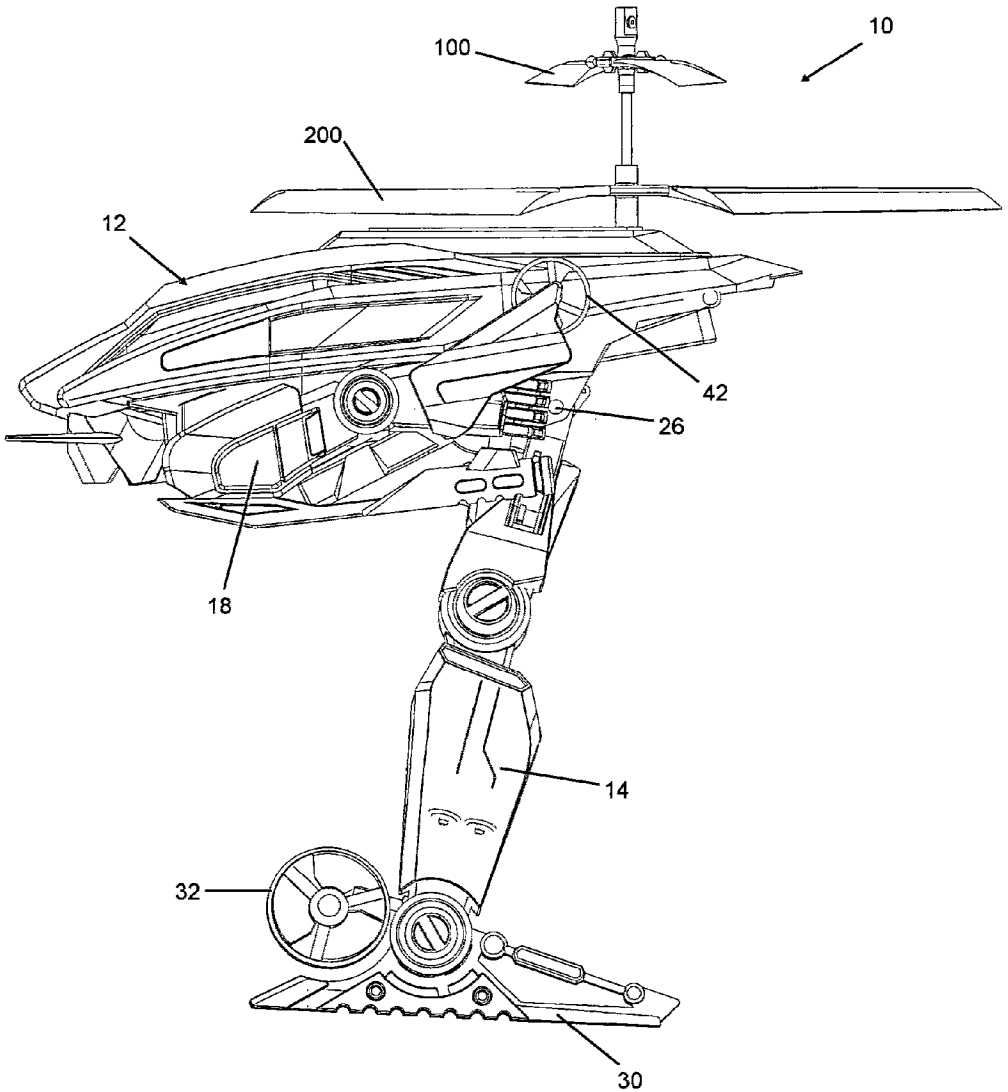
FIG. 6 is a left side view of the transformable toy vehicle in a takeoff/landing position.

To return the transformable toy vehicle 10 to the standing position as shown in FIG. 1, the rotational speed of blades 100 and 200 is increased sufficiently to lift the transformable toy vehicle 10 off the ground and to a sufficient height, whereupon legs 14, 16 are rotated downward to a position 90 degrees with respect to main body 12 as shown in FIG. 6. At the same time, arms 18, 20 are rotated counterclockwise back into the position shown in FIG. 6, the position of the rotating blade system 300 is adjusted as necessary to maintain the proper center of gravity for stable flight, and throttle speed is reduced so that altitude drops and the transformable toy vehicle 10 contacts the ground surface, landing on its feet 30. Main body 12 is then rotated back 90 degrees to a vertical standing position parallel with legs 14, 16 and arms 18, 20 are rotated clockwise about 45 degrees back to the position shown in FIG. 1.

Figure 24:
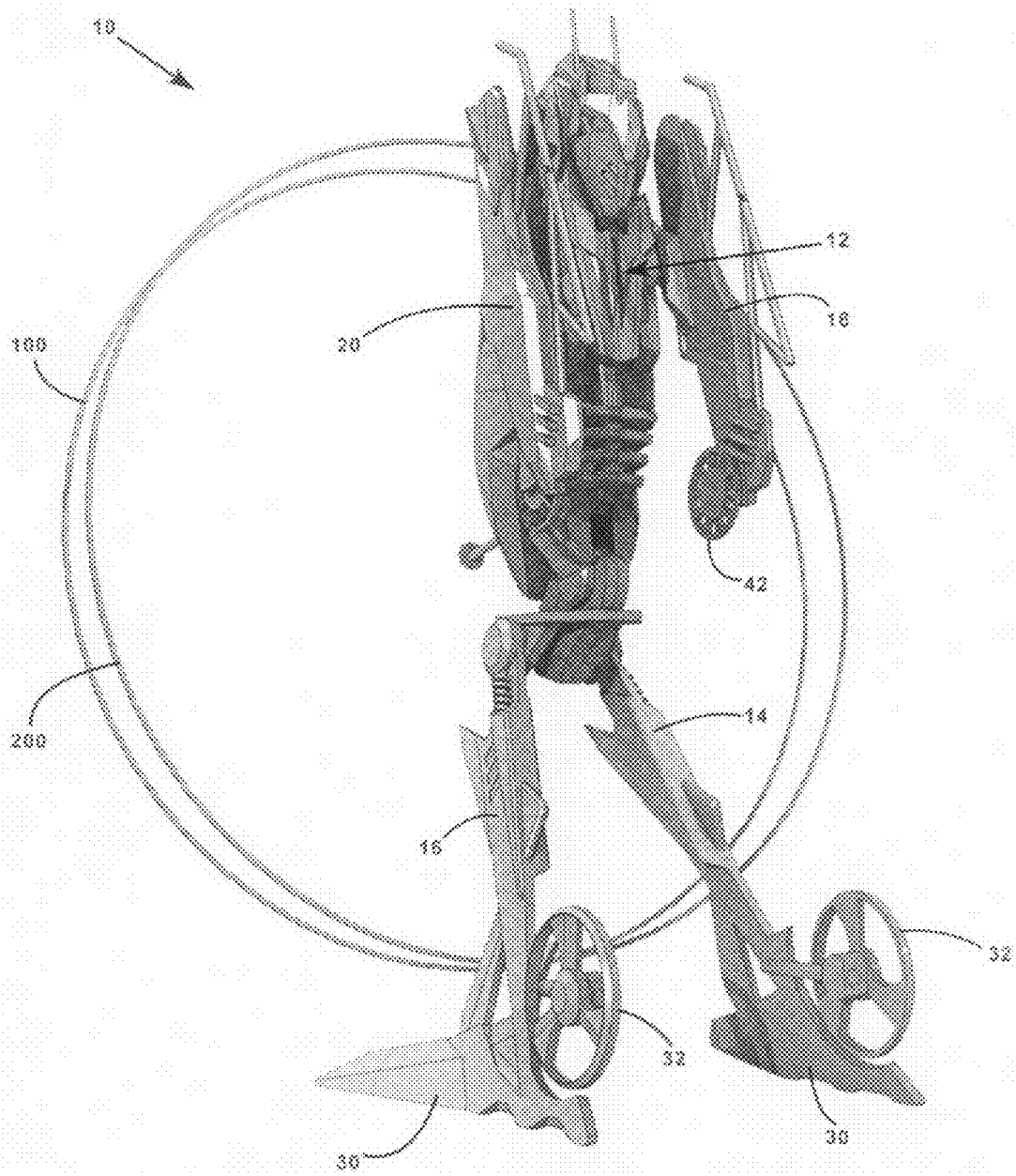
FIG. 24 is a right side perspective view of an alternate version of the transformable toy vehicle in a standing position, showing the rotor blades in schematic form.
Figure 25:
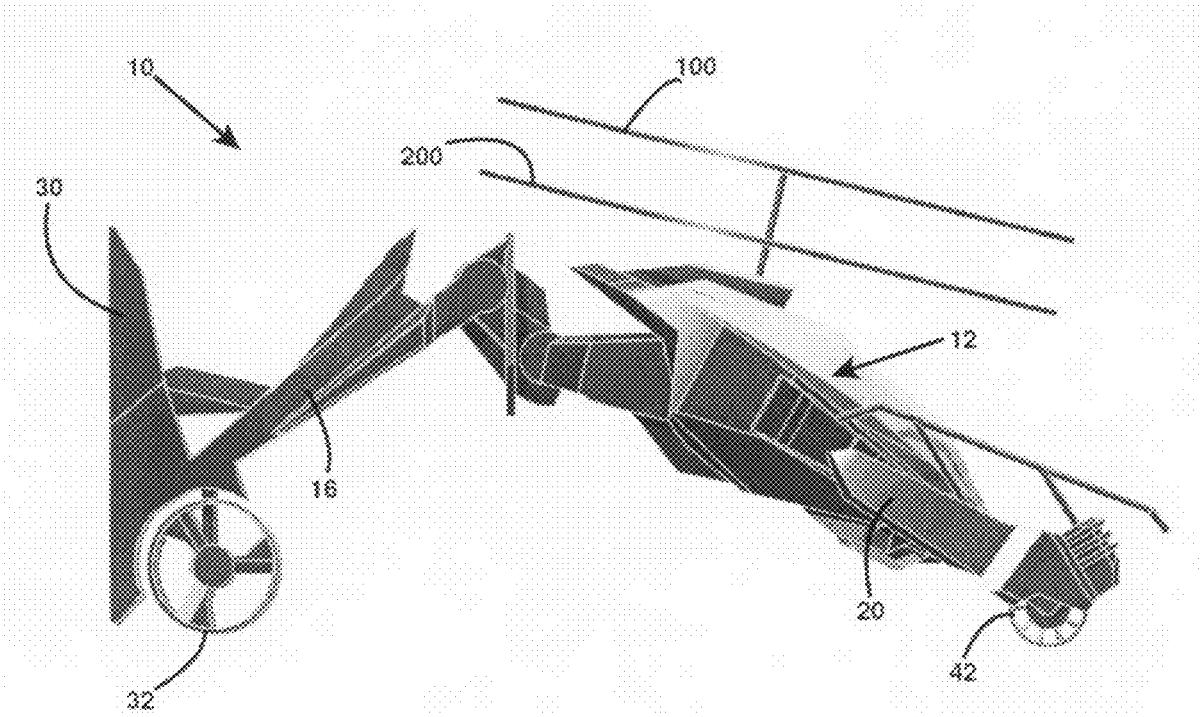
FIG. 25 is a right side view of the alternate version of the transformable toy vehicle shown in FIG. 24, in a driving position.

An outer shell 60, comprising various segments, may cover the internal parts of the transformable toy vehicle 10. The outer shell 60 may be designed to give the transformable toy vehicle 10 the appearance of a machine, such as a robot (see FIGS. 1-20) or an automobile, or a creature, such as an insect (see FIGS. 24 and 25).

One of the main advantages of the present transformable toy vehicle 10 is the ability to dynamically transform from a standing mode, to a flying mode, and then to a driving mode and back again, all while balancing all in-flight forces and maintaining the correct center of gravity for stable flight, takeoff and landing. A further advantage is that the transformations from one mode to another are accomplished automatically by remote control signals and can be done while the transformable toy vehicle 10 is in flight. Another advantage is that the transformable toy vehicle 10 can land in any one of at least two modes/positions. The first, is on legs 14, 16 in the landing/takeoff position as shown in FIGS. 6 to 10, and the second is on both legs 14, 16 and arms 18, 20 in the driving position as shown in FIGS. 16 to 20, wherein the transformable toy vehicle 10 is then immediately operable as a wheeled vehicle. Another advantage is the ability to steer the transformable toy vehicle 10, both in the air and on the ground, by differentially driving blades 100, 200 at different relative speeds.

It will be appreciated by persons skilled in the art that the present transformable flying toy vehicle 10 is not limited by what has been particularly shown and described hereinabove. Rather the scope of the present invention includes both combinations and sub combinations of the various features described hereinabove as well as variations and modifications which would occur to persons skilled in the art upon reading the specification and which are not in the prior art.

What is claimed is:

1. A transformable toy vehicle comprising:

a main upper body portion;

a lower body portion rotatably connected to said upper body portion, said lower body portion being selectively retainable at various angles relative to an upper body central axis between a first body position where said upper body central axis is generally parallel with a lower body central axis and a second body position where said upper body central axis is at approximately a 90 degree angle relative to said lower body central axis;

a rotating blade system including a main drive shaft and at least two lifting blades connected to said drive shaft, said rotating blade system mounted to a back portion of said upper body portion such that said main drive shaft is generally perpendicular to said upper body central axis, and said lifting blades are generally parallel to said upper body central axis;

a main drive means connected to said main drive shaft for driving the at least two lifting blades;

an auxiliary body drive means for selectively rotating said upper body portion with respect to said lower body portion between said first body position and said second body position; and a vehicle control unit for controlling said main drive means and said auxiliary body drive means in response to remote control signals, said vehicle control unit comprising:

a micro-processor with memory; and a receiver for receiving said remote control signals.

2. The transformable toy vehicle of claim 1, including at least two arm portions rotatably affixed to said main upper body portion, said arm portions being rotatable between a first backward-facing flying position and a second forward-facing driving position.

3. The transformable toy vehicle of claim 2, including an auxiliary arm drive means for driving said rotation of said arm portions between said first flying position and said second driving position, said auxiliary arm drive means being controlled by said vehicle control unit in response to said remote control signals.

4. The transformable toy vehicle of claim 2, wherein each of said arm portions includes at least one wheel rotatably affixed thereto, such that when said arm portions are in said forward-facing driving position said wheels are engagable with a ground surface for supporting the toy vehicle for movement over said ground surface.

5. The transformable toy vehicle of claim 4, wherein said lower body portion includes at least one wheel rotatably affixed thereto, said at least one wheel being engagable with a ground surface for supporting the toy vehicle for movement over said ground surface when said arm portions are in said forward-facing driving position.

6. The transformable toy vehicle of claim 1, wherein said lower body portion comprises at least two legs rotatably affixed to said lower body portion, said legs rotatable on a common plain between a first position parallel to said lower body central axis and a second position wherein said legs are spread-apart forming an acute angle with said lower body central axis.

7. The transformable toy vehicle of claim 6, including an auxiliary leg drive means for driving said rotation of said legs between said first parallel position and said second spread-apart position, said auxiliary leg drive means being controlled by said vehicle control unit in response to said remote control signals.

8. The transformable toy vehicle of claim 1, wherein said main drive shaft includes inner and outer coaxial drive shaft portions and wherein one of said at least two lifting blades is connected to said inner drive shaft and another one of said at least two lifting blades is connected to said outer drive shaft and wherein said at least two lifting blades are counter-rotating.

9. The transformable toy vehicle of claim 8, wherein said inner drive shaft can be driven at a different rotational speed relative to said outer drive shaft.

10. The transformable toy vehicle of claim 9, wherein said at least two lifting blades each have a forward bias.

11. The transformable toy vehicle of claim 1, wherein said rotating blade system includes at least one set of bell stabilizers connected to said main drive shaft.

12. The transformable toy vehicle of claim 1, including an auxiliary rotating blade system drive means for moving said rotating blade system forward and backward on said upper body portion parallel with said upper body central axis, said auxiliary blade system drive means being controlled by said vehicle control unit so as to optimally maintain a center of gravity of said transformable toy vehicle suitable for stable flight as said upper body portion and said lower body portion are selectively retained at said various relative angles.

13. The transformable toy vehicle of claim 1, including an outer shell portion designed to give the transformable toy vehicle the appearance of a machine or a creature.

14. A transformable toy vehicle comprising:

a main upper body portion;

a lower body portion rotatably connected to said upper body portion, said lower body portion being selectively retainable at various angles relative to an upper body central axis between a first body position where said upper body central axis is generally parallel with a lower body central axis and a second body position where said upper body central axis is at approximately a 90 degree angle relative to said lower body central axis;

a rotating blade system including a main drive shaft and at least two lifting blades connected to said drive shaft, said rotating blade system mounted to a back portion of said upper body portion such that said main drive shaft is generally perpendicular to said upper body central axis, and said lifting blades are generally parallel to said upper body central axis;

at least two arms rotatably affixed to said main upper body portion, said arms being rotatable between a first backward-facing flying position and a second forward-facing driving position;

at least two legs rotatably affixed to said lower body portion, said legs rotatable on a common plain between a first position parallel to said lower body central axis and a second position wherein said legs are spread-apart forming an acute angle with said lower body central axis;

a main drive means connected to said main drive shaft for driving the at least two lifting blades;

an auxiliary body drive means for selectively rotating said upper body portion with respect to said lower body portion between said first body position and said second body position;

an auxiliary arm drive means for driving said rotation of said arms between said first flying position and said second driving position;

an auxiliary leg drive means for driving said rotation of said legs between said first parallel position and said second spread-apart position;

an auxiliary rotating blade system drive means for moving said rotating blade system forward and backward on said upper body portion parallel with said upper body central axis; and a vehicle control unit for controlling said main drive means, said auxiliary drive means, said auxiliary arm drive means, said auxiliary leg drive means and said auxiliary blade system drive means in response to remote control signals, said vehicle control unit comprising:

a micro-processor with memory; and a receiver for receiving said remote control signals.

15. The transformable toy vehicle of claim 14, wherein said vehicle control unit controls the body position of said upper body portion relative to said lower body portion, said rotation of said arms, said rotation of said legs, and said forward and backward movement of said rotating blade system so as to optimally maintain a center of gravity of said transformable toy vehicle suitable for stable flight.

16. The transformable toy vehicle of claim 14, wherein each of said arms and said legs includes at least one wheel rotatably affixed thereto, such that when said arms are in said forward-facing driving position said wheels are engagable with a ground surface for supporting the toy vehicle for movement over said ground surface.

17. The transformable toy vehicle of claim 14, wherein said main drive shaft includes inner and outer coaxial drive shaft portions and wherein one of said at least two lifting blades is connected to said inner drive shaft and another one of said at least two lifting blades is connected to said outer drive shaft and wherein said lifting blades are counter-rotating.

18. The transformable toy vehicle of claim 17, wherein said inner drive shaft can be driven at a different rotational speed relative to said outer drive shaft.

19. The transformable toy vehicle of claim 18, wherein said at least two lifting blades each have a forward bias.

20. The transformable toy vehicle of claim 14, wherein said rotating blade system includes at least one set of bell stabilizers connected to said main drive shaft.

21. The transformable toy vehicle of claim 14, including an outer shell portion designed to give the transformable toy vehicle the appearance of a machine or a creature.

22. A transformable toy vehicle comprising:

a main upper body portion;

a lower body portion rotatably connected to said upper body portion, said lower body portion being selectively retainable at various angles relative to an upper body central axis between a first body position where said upper body central axis is generally parallel with a lower body central axis and a second body position where said upper body central axis is at approximately a 90 degree angle relative to said lower body central axis;

at least two arm portions rotatably affixed to said main upper body portion, said arm portions being rotatable between a first backward-facing flying position and a second forward-facing driving position;

a rotating blade system including a main drive shaft and at least two lifting blades connected to said drive shaft, said rotating blade system mounted to a back portion of said upper body portion such that said main drive shaft is generally perpendicular to said upper body central axis, and said lifting blades are generally parallel to said upper body central axis;

a main drive means connected to said main drive shaft for driving the at least two lifting blades; and a vehicle control unit for controlling said main drive means in response to remote control signals, said vehicle control unit comprising:

a micro-processor with memory; and a receiver for receiving said remote control signals.

23. A transformable toy vehicle comprising:

a main upper body portion;

a lower body portion rotatably connected to said upper body portion, said lower body portion being selectively retainable at various angles relative to an upper body central axis between a first body position where said upper body central axis is generally parallel with a lower body central axis and a second body position where said upper body central axis is at approximately a 90 degree angle relative to said lower body central axis, said lower body portion comprising at least two legs rotatably affixed to said lower body portion, said legs rotatable on a common plain between a first position parallel to said lower body central axis and a second position wherein said legs are spread-apart forming an acute angle with said lower body central axis;

a rotating blade system including a main drive shaft and at least two lifting blades connected to said drive shaft, said rotating blade system mounted to a back portion of said upper body portion such that said main drive shaft is generally perpendicular to said upper body central axis, and said lifting blades are generally parallel to said upper body central axis;

a main drive means connected to said main drive shaft for driving the at least two lifting blades; and a vehicle control unit for controlling said main drive means in response to remote control signals, said vehicle control unit comprising:

a micro-processor with memory; and a receiver for receiving said remote control signals.

24. A transformable toy vehicle comprising:

a main upper body portion;

a lower body portion rotatably connected to said upper body portion, said lower body portion being selectively retainable at various angles relative to an upper body central axis between a first body position where said upper body central axis is generally parallel with a lower body central axis and a second body position where said upper body central axis is at approximately a 90 degree angle relative to said lower body central axis;

a rotating blade system including a main drive shaft and at least two lifting blades connected to said drive shaft, said rotating blade system mounted to a back portion of said upper body portion such that said main drive shaft is generally perpendicular to said upper body central axis, and said lifting blades are generally parallel to said upper body central axis;

a main drive means connected to said main drive shaft for driving the at least two lifting blades;

a vehicle control unit for controlling said main drive means in response to remote control signals, said vehicle control unit comprising:

a micro-processor with memory;

a receiver for receiving said remote control signals; and an auxiliary rotating blade system drive means for moving said rotating blade system forward and backward on said upper body portion parallel with said upper body central axis, said auxiliary blade system drive means being controlled by said vehicle control unit so as to optimally maintain a center of gravity of said transformable toy vehicle suitable for stable flight as said upper body portion and said lower body portion are selectively retained at said various relative angles.

* * * * *